US009698463B2

(12) United States Patent
Wild et al.

(10) Patent No.: US 9,698,463 B2
(45) Date of Patent: Jul. 4, 2017

(54) ADJUSTABLE POWER DIVIDER AND DIRECTIONAL COUPLER

(71) Applicant: John Mezzalingua Associates, LLC, Liverpool, NY (US)

(72) Inventors: Werner Wild, Buttenwiessen (DE); Ian J. Baker, Baldwinsville, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 14/838,694

(22) Filed: Aug. 28, 2015

(65) Prior Publication Data

US 2016/0064798 A1 Mar. 3, 2016

Related U.S. Application Data

(60) Provisional application No. 62/043,552, filed on Aug. 29, 2014.

(51) Int. Cl.

| | |
|---|---|
| ***H01P 5/20*** | (2006.01) |
| ***H01P 5/12*** | (2006.01) |
| ***H01P 5/18*** | (2006.01) |
| ***H01P 5/04*** | (2006.01) |
| *H01R 24/54* | (2011.01) |

(52) U.S. Cl.

CPC ..... *H01P 5/183* (2013.01); *H01P 5/04* (2013.01); *H01P 5/12* (2013.01); *H01R 24/547* (2013.01)

(58) Field of Classification Search

CPC ..... H01P 5/04; H01P 5/18; H01P 5/183

USPC ..... 333/109–112, 117, 121, 127

See application file for complete search history.

(56) References Cited

U.S. PATENT DOCUMENTS

| | | | | |
|---|---|---|---|---|
| 2,531,777 | A * | 11/1950 | Marshall | H01P 5/04 324/95 |
| 3,105,207 | A * | 9/1963 | Capewell | H01P 5/04 333/111 |
| 3,166,723 | A * | 1/1965 | Bock | H01P 5/04 333/111 |
| 4,669,816 | A | 6/1987 | Thompson | |
| 4,693,546 | A | 9/1987 | Lorenzo et al. | |
| 4,953,935 | A | 9/1990 | Suchoski, Jr. et al. | |
| 5,365,577 | A | 11/1994 | Davis et al. | |
| 5,448,663 | A | 9/1995 | Faulkner et al. | |
| 5,742,210 | A | 4/1998 | Chaturvedi et al. | |

(Continued)

FOREIGN PATENT DOCUMENTS

| | | | | |
|---|---|---|---|---|
| DE | WO 2013013745 A1 * | 1/2013 | | H01P 5/12 |
| WO | WO9103753 A1 | 3/1991 | | |

(Continued)

*Primary Examiner* — Dean Takaoka

(74) *Attorney, Agent, or Firm* — Barclay Damon, LLP

(57) ABSTRACT

A power divider including an input port receiving an electrical power input, a coupled port transmitting a portion of the power input, and a transmitted port transferring a remaining portion of the power input from the input port. A first conductor produces an electrical field and electrically connects the input port to the transmitted port. And, a second conductor, disposed within electrical field of the first conductor, electrically connects to the coupled port, the second conductor. The first and second conductors are configured to be variably spaced to vary the coupling factor between the input and transmitted portions of the input power.

13 Claims, 24 Drawing Sheets

(56) References Cited

U.S. PATENT DOCUMENTS

| | | | | |
|---|---|---|---|---|
| 5,801,600 | A * | 9/1998 | Butland | H01Q 3/32 333/127 |
| 5,861,840 | A | 1/1999 | Tarran et al. | |
| 6,191,854 | B1 | 2/2001 | Grasso et al. | |
| 6,282,405 | B1 | 8/2001 | Brown | |
| 6,289,699 | B1 | 9/2001 | Kewitsch et al. | |
| 6,496,626 | B2 | 12/2002 | Spagnoletti et al. | |
| 6,788,165 | B2 | 9/2004 | Runyon | |
| 6,972,639 | B2 | 12/2005 | Podell | |
| 7,026,888 | B2 * | 4/2006 | Antkowiak | H01P 5/183 333/121 |
| 7,183,876 | B2 * | 2/2007 | Fallon | H01P 5/04 333/109 |
| 7,190,240 | B2 | 3/2007 | Podell | |
| 7,221,239 | B2 | 5/2007 | Runyon | |
| 7,345,557 | B2 | 3/2008 | Podell | |
| 7,429,903 | B2 * | 9/2008 | Antkowiak | H01P 5/183 333/109 |
| 7,577,331 | B2 | 8/2009 | Laurisch et al. | |
| 8,076,796 | B1 | 12/2011 | Robinson et al. | |
| 8,120,444 | B2 * | 2/2012 | Haunberger | H01P 5/12 333/121 |
| 8,212,390 | B1 | 7/2012 | Robinson et al. | |
| 8,299,871 | B2 | 10/2012 | Carrillo-Ramirez | |
| 8,570,116 | B2 | 10/2013 | Podell | |
| 8,831,593 | B2 | 9/2014 | Melester et al. | |
| 8,981,871 | B2 | 3/2015 | Hanna et al. | |
| 9,300,026 | B2 * | 3/2016 | Haunberger | H01P 5/12 |
| 2002/0081081 | A1 | 6/2002 | Spagnoletti et al. | |
| 2005/0122185 | A1 | 6/2005 | Podell | |
| 2006/0066418 | A1 | 3/2006 | Podell | |
| 2007/0159268 | A1 | 7/2007 | Podell | |
| 2009/0180731 | A1 | 7/2009 | Christensen et al. | |
| 2011/0199166 | A1 | 8/2011 | Carrillo-Ramirez | |
| 2012/0019335 | A1 | 1/2012 | Hoang et al. | |
| 2013/0069739 | A1 | 3/2013 | Podell | |
| 2013/0071112 | A1 | 3/2013 | Melester et al. | |
| 2014/0111285 | A1 | 4/2014 | Rogers | |
| 2014/0342674 | A1 | 11/2014 | Melester et al. | |

FOREIGN PATENT DOCUMENTS

| | | | |
|---|---|---|---|
| WO | WO93-22869 | A1 | 11/1993 |
| WO | WO9836467 | A1 | 8/1998 |
| WO | WO0035199 | A1 | 6/2000 |
| WO | WO02063792 | A1 | 8/2002 |
| WO | WO2005060436 | A2 | 7/2005 |
| WO | WO2012012206 | A2 | 1/2012 |
| WO | WO2013040589 | A1 | 3/2013 |
| WO | WO2014062904 | A1 | 4/2014 |

* cited by examiner

ADJUSTABLE POWER DIVIDER AND DIRECTIONAL COUPLER

PRIORITY CLAIM

This application is a Non-Provisional Utility Patent Application of, and claims the benefit and priority of, U.S. Provisional Patent Application Ser. No. 62/043,552, filed on Aug. 29, 2014.

BACKGROUND

An antenna array commonly employs a plurality of individual antennas each demanding a specific power requirement. To meet these power requirements, a power source is typically split or divided to meet the individual needs of each antenna. Existing power dividers are designed to provide specific power ratios or coupling factors between input and output ports (the output ports often being referred to as the transmitted and coupled ports).

For example, a ten (10) antenna array may be powered by a twenty Watt (20 W) input and split as follows: (1) a twenty Watt (20 W) input split into eighteen Watts (18 W) on a transmitted port and two Watts (2 W) on a coupled port using a minus ten dB (−10.0 dB) power divider; (2) the eighteen Watt (18 W) input split into sixteen Watts (16 W) on a transmitted port and two Watts (2 W) on a coupled port using a minus nine and one half dB (−9.5 dB) power divider; (3) the sixteen Watt (16 W) input split into fourteen Watts (14 W) on a transmitted port and two Watts (2 W) on a coupled port using a minus nine dB (−9.0 dB) power divider; (4) the fourteen Watt (14 W) input split into twelve Watts (12 W) on a transmitted port and two Watts (2 W) on a coupled port by a minus eight and one half dB (−8.5 dB) power divider; (5) the twelve Watt (12 W) input split into ten Watts (10 W) on a transmitted port and two Watts (2 W) on a coupled port by a minus seven and seven tenths dB (−7.8 dB) power divider; (6) the ten Watt (10 W) input split into eight Watts (8 W) on a transmitted port and two Watts (2 W) on a coupled port by a minus seven dB (−7.0 dB) power divider; (7) the eight Watt (8 W) input split into six Watts (6 W) on a transmitted port and two Watts (2 W) on a coupled port using a minus six dB (−6.0 dB) power divider; (8) the six Watt (6 W) input split into four Watts (4 W) on a transmitted port and two Watts (2 W) on a coupled port by a minus four and seven tenths dB (−4.8 dB) power divider; and (9) the four Watt (4 W) input split into two Watts (2 W) on a transmitted port and two Watts (2 W) on a coupled port by a minus three dB (−3.0 dB) power divider.

In the foregoing example, as many as nine (9) power dividers, each splitting the power differently and having a different coupling factor or power ratio, are required to power the array of RF antennae. As a consequence, a technician must inventory a large quantity and variety of power dividers/couplers to ensure that the specifications are met and/or that repairs can be made to any one of the in-service power dividers/couplers. Furthermore, a technician must have an in-depth knowledge of the power dividers/directional couplers to achieve the proper tuning and RF performance. Each of these factors can add significantly to the cost of fabrication, construction and repair of a power antenna array.

Therefore, there is a need to overcome, or otherwise lessen the effects of, the disadvantages and shortcomings described above.

SUMMARY

A power divider is provided including an input port receiving an electrical power input, a coupled port transmitting a portion of the power input, and a transmitted port transferring a remaining portion of the power input from the input port. A first conductor produces an electrical field and electrically connects the input port to the transmitted port. And, a second conductor, disposed within electrical field of the first conductor, electrically connects to the coupled port, the second conductor. The first and second conductors are configured to be variably spaced to vary the coupling factor between the input and transmitted portions of the input power.

BRIEF DESCRIPTION OF THE DRAWINGS

Additional features and advantages of the present disclosure are described in, and will be apparent from, the following Brief Description of the Drawings and Detailed Description.

DETAILED DESCRIPTION

1.0 Overview Wireless Communication Networks

In one embodiment, wireless communications are operable based on a network switching subsystem ("NSS"). The NSS includes a circuit-switched core network for circuit-switched phone connections. The NSS also includes a general packet radio service architecture which enables mobile networks, such as 2G, 3G and 4G mobile networks, to transmit Internet Protocol ("IP") packets to external networks such as the Internet. The general packet radio service architecture enables mobile phones to have access to services such as Wireless Application Protocol ("WAP"), Multimedia Messaging Service ("MSS") and the Internet.

A service provider or carrier operates a plurality of centralized mobile telephone switching offices ("MTSOs"). Each MTSO controls the base stations within a select region or cell surrounding the MTSO. The MTSOs also handle connections to the Internet and phone connections.

Figure 1:
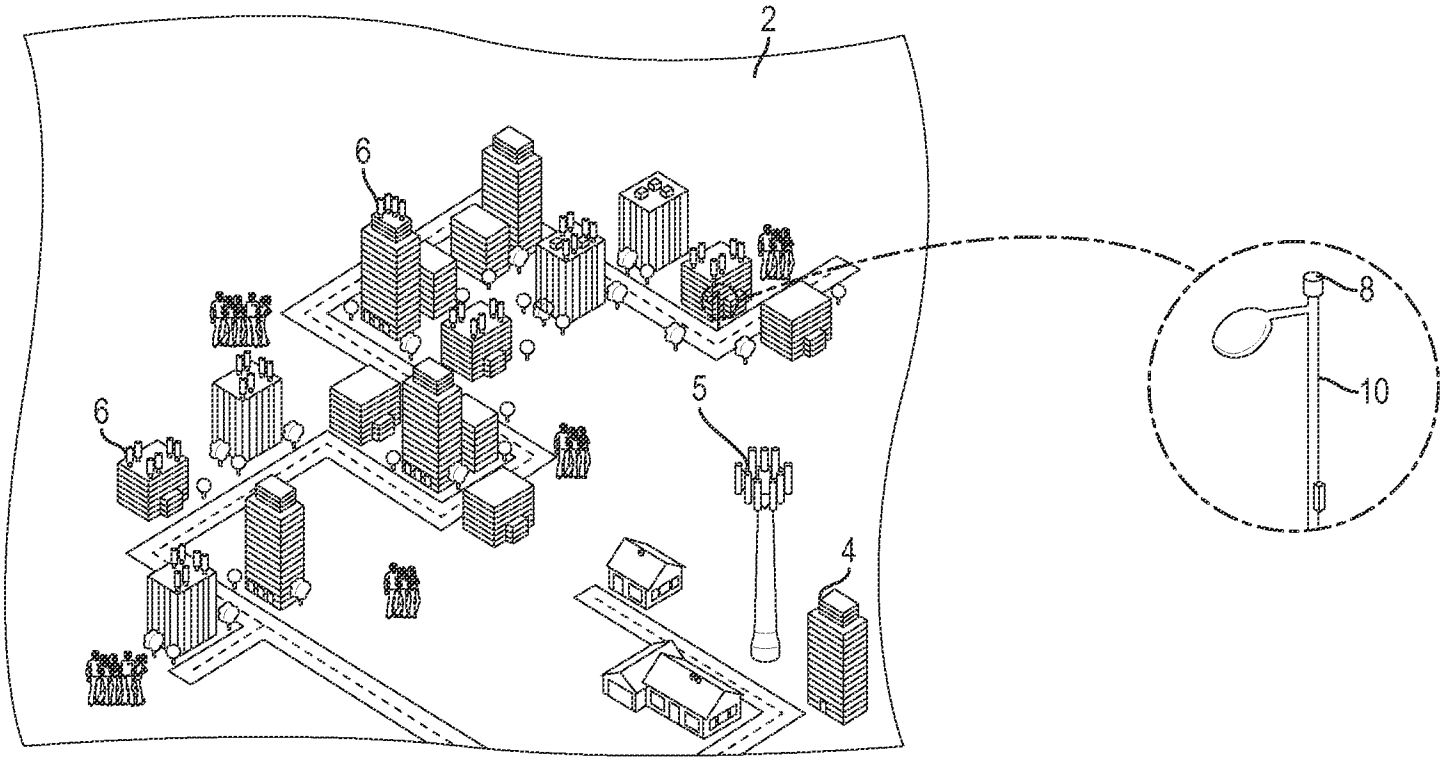
FIG. 1 is a schematic diagram illustrating an example of one embodiment of an outdoor wireless communication network.

Referring to FIG. 1, an outdoor wireless communication network 2 includes a cell site or cellular base station 4. The base station 4, in conjunction with cellular tower 5, serves communication devices, such as mobile phones, in a defined area surrounding the base station 4. The cellular tower 5 also communicates with macro antennas 6 on building tops as well as micro antennas 8 mounted to, for example, street lamps 10.

The cell size depends upon the type of wireless network. For example, a macro cell can have a base station antenna installed on a tower or a building above the average rooftop level, such as the macro antennas 5 and 6. A micro cell can have an antenna installed at a height below the average rooftop level, often suitable for urban environments, such as the street lamp-mounted micro antenna 8. A picocell is a relatively small cell often suitable for indoor use.

Figure 2:
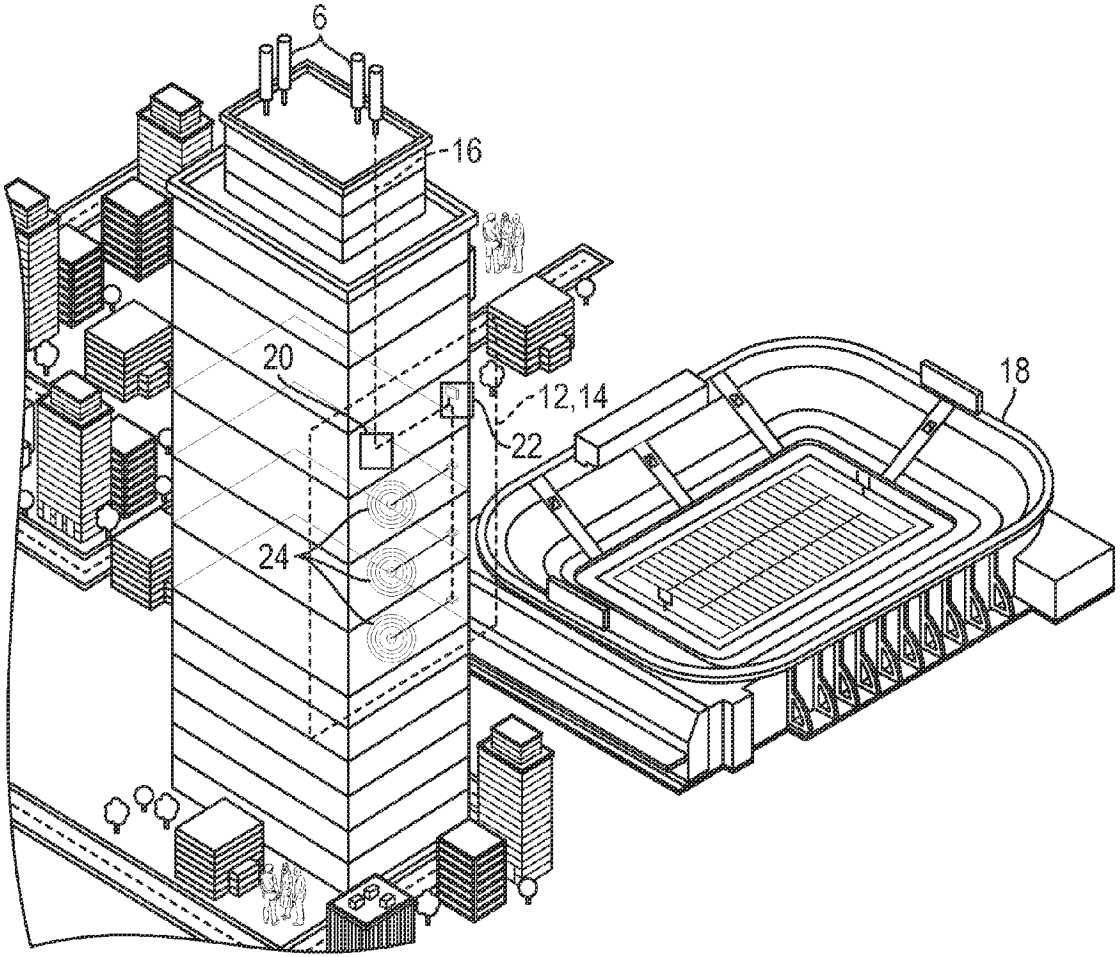
FIG. 2 is a schematic diagram illustrating an example of one embodiment of an indoor wireless communication network.

As illustrated in FIG. 2, an indoor wireless communication network 12 includes an active distributed antenna system ("DAS") 14. The DAS 14 can, for example, be installed in a high rise commercial office building 16, a sports stadium 8 or a shopping mall. In one embodiment, the DAS 14 includes macro antennas 6 coupled to a radio frequency ("RF") repeater 20. The macro antennas 6 receive signals from a nearby base station. The RF repeater 20 amplifies and repeats the received signals. The RF repeater 20 is coupled to a DAS master unit 22 which, in turn, is coupled to a plurality of remote antenna units 24 distributed throughout the building 16. Depending upon the embodiment, the DAS master unit 22 can manage over one hundred remote antenna units 24 in a building. In operation, the master unit 22, as programmed and controlled by a DAS manager, is operable to control and manage the coverage and performance of the remote antenna units 24 based on the number of repeated signals fed by the repeater 20. It should be appreciated that a technician can remotely control the master unit 22 through a Local Area Network (LAN) connection or wireless modem.

Depending upon the embodiment, the RF repeater 20 can be an analog repeater that amplifies all received signals, or the RF repeater 20 can be a digital repeater. In one embodiment, the digital repeater includes a processor and a memory device or data storage device. The data storage device stores logic in the form of computer-readable instructions. The processor executes the logic to filter or clean the received signals before repeating the signals. In one embodiment, the digital repeater does not need to receive signals from an external antenna, but rather, has a built-in antenna located within its housing.

Base Stations

Figure 3:
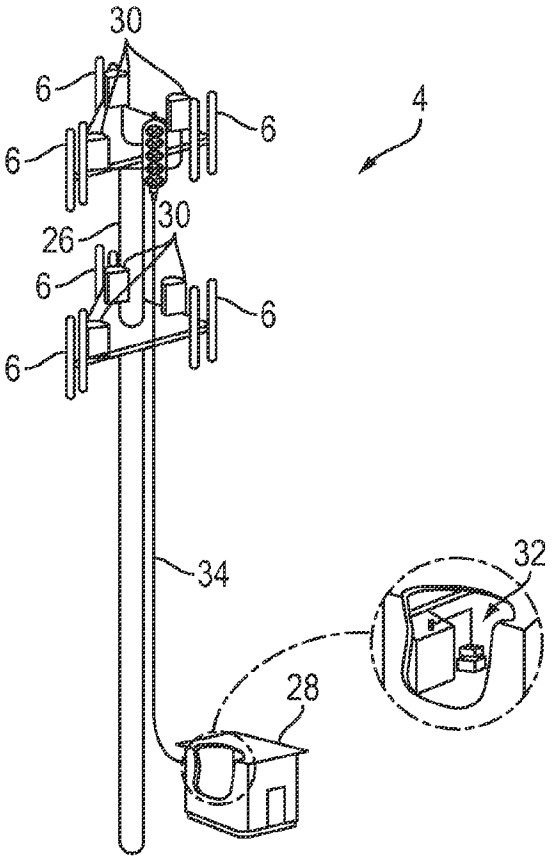
FIG. 3 is an isometric view of one embodiment of a base station illustrating a tower and ground shelter.

In one embodiment illustrated in FIG. 3, the base station 4 includes a tower 26 and a ground shelter 28 proximal to the tower 26. In this example, a plurality of exterior antennas 6 and remote radio heads 30 are mounted to the tower 26. The shelter 28 encloses base station equipment 32. Depending upon the embodiment, the base station equipment 32 includes electrical hardware operable to transmit and receive radio signals and to encrypt and decrypt communications with the MTSO. The base station equipment 32 also includes power supply units and equipment for powering and controlling the antennas and other devices mounted to the tower 26.

In one embodiment, a distribution line 34, such as coaxial cable or fiber optic cable, distributes signals that are exchanged between the base station equipment 32 and the remote radio heads 30. Each remote radio head 30 is operatively coupled, and mounted adjacent, a group of associated macro antennas 6. Each remote radio head 30 manages the distribution of signals between its associated macro antennas 6 and the base station equipment 30. In one embodiment, the remote radio heads 30 extend the coverage and efficiency of the macro antennas 6. The remote radio heads 30, in one embodiment, have RF circuitry, analog-to-digital/digital-to-analog converters and up/down converters.

Antennas

The antennas, such as macro antennas 6, micro antennas 8 and remote antenna units 24, are operable to receive signals from communication devices and send signals to the communication devices. Depending upon the embodiment, the antennas can be of different types, including, but not limited to, directional antennas, omni-directional antennas, isotropic antennas, dish-shaped antennas, and microwave antennas. Directional antennas can improve reception in higher traffic areas, along highways, and inside buildings like stadiums and arenas. Based upon applicable laws, a service provider may operate omni-directional cell tower signals up to a maximum power, such as 100 watts, while the service provider may operate directional cell tower signals up to a higher maximum of effective radiated power ("ERP"), such as 500 watts.

An omni-directional antenna is operable to radiate radio wave power uniformly in all directions in one plane. The radiation pattern can be similar to a doughnut shape where the antenna is at the center of the donut. The radial distance from the center represents the power radiated in that direction. The power radiated is maximum in horizontal directions, dropping to zero directly above and below the antenna.

An isotropic antenna is operable to radiate equal power in all directions and has a spherical radiation pattern. Omni-directional antennas, when properly mounted, can save energy in comparison to isotropic antennas. For example, since their radiation drops off with elevation angle, little radio energy is aimed into the sky or down toward the earth where it could be wasted. In contrast, isotropic antennas can waste such energy.

In one embodiment, the antenna has: (a) a transceiver movably mounted to an antenna frame; (b) a transmitting data port, a receiving data port, or a transceiver data port; (c) an electrical unit having a PC board controller and motor; (d) a housing or enclosure that covers the electrical unit; and (e) a drive assembly or drive mechanism that couples the motor to the antenna frame. Depending upon the embodiment, the transceiver can be tiltably, pivotably or rotatably mounted to the antenna frame. One or more cables connect the antenna's electrical unit to the base station equipment 32 for providing electrical power and motor control signals to the antenna. A technician of a service provider can reposition the antenna by providing desired inputs using the base station equipment 32. For example, if the antenna has poor reception, the technician can enter tilt inputs to change the tilt angle of the antenna from the ground without having to climb up to reach the antenna. As a result, the antenna's motor drives the antenna frame to the specified position. Depending upon the embodiment, a technician can control the position of the movable antenna from the base station, from a distant office or from a land vehicle by providing inputs over the Internet.

Data Interface Ports

Generally, the networks 2 and 12 include a plurality of wireless network devices, including, but not limited to, the base station equipment 32, one or more radio heads 30, macro antennas 6, micro antennas 8, RF repeaters 20 and remote antenna units 24. As described above, these network devices include data interface ports which couple to connectors of signal-carrying cables, such as coaxial cables and fiber optic cables. In the example illustrated in FIG. 4, the tower 36 supports a radio head 38 and macro antenna 40. The radio head 38 has interface ports 42, 43 and 44 and the macro antenna 40 has antenna ports 45 and 47. In the example shown, the coaxial cable 48 is connected to the radio head interface port 42, while the coaxial cable jumpers 50 and 51 are connected to radio head interface ports 44 and 45, respectively. The coaxial cable jumpers 50 and 51 are also connected to antenna interface ports 45 and 47, respectively.

The interface ports of the networks 2 and 12 can have different shapes, sizes and surface types depending upon the embodiment. In one embodiment illustrated in FIG. 5, the interface port 52 has a tubular or cylindrical shape. The interface port 52 includes: (a) a forward end or base 54 configured to abut the network device enclosure, housing or wall 56 of a network device; (b) a coupler engager 58 configured to be engaged with a cable connector's coupler, such as a nut; (c) an electrical ground 60 received by the coupler engager 58; and (d) a signal carrier 62 received by the electrical grounder 60.

Figure 6:
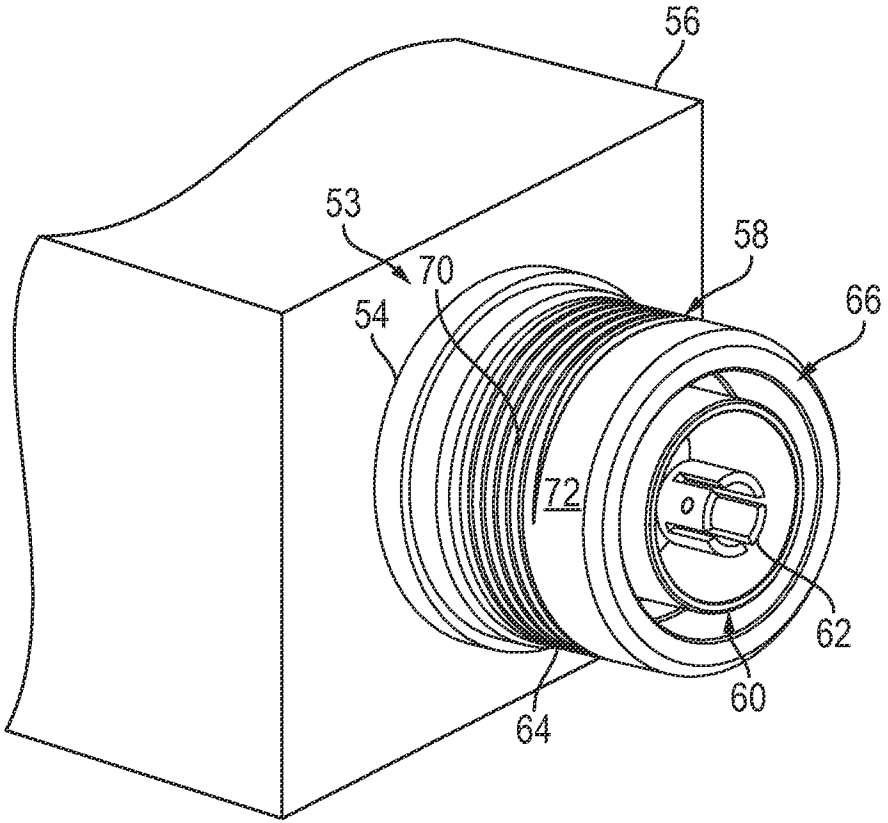
FIG. 6 is an isometric view of another embodiment of an interface port.
Figure 7:
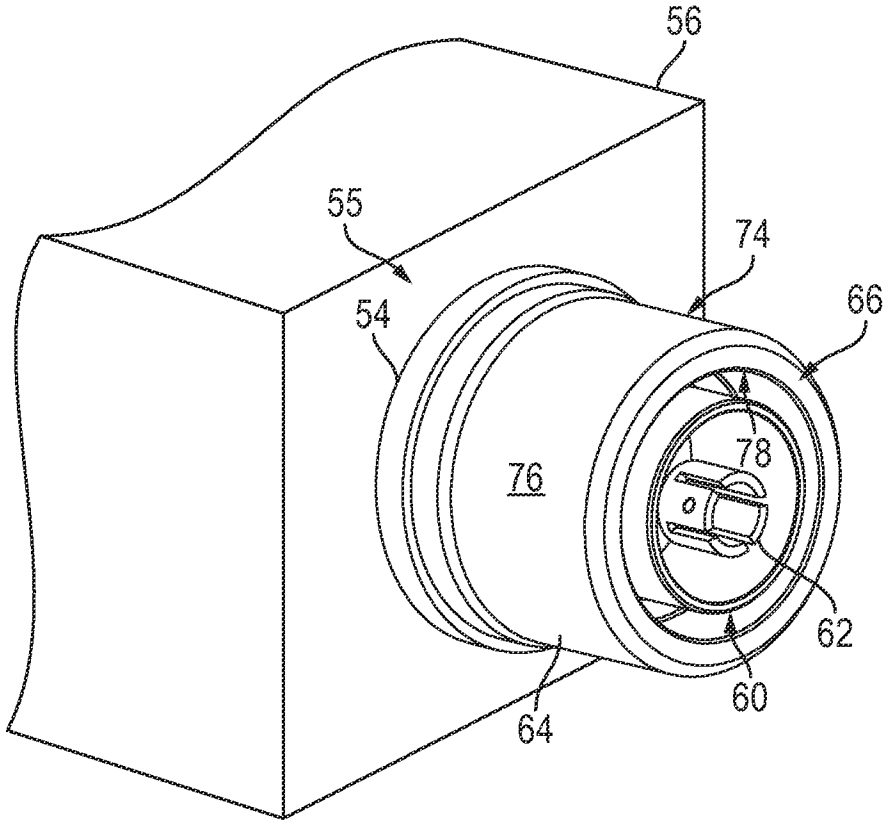
FIG. 7 is an isometric view of yet another embodiment of an interface port.

In the illustrated embodiment, the base 54 has a collar shape with a diameter larger than the diameter of the coupler engager 58. The coupler engager 58 is tubular in shape, has a threaded, outer surface 64 and a rearward end 66. The threaded outer surface 64 is configured to threadably mate with the threads of the coupler of a cable connector, such as connector 68 described below. In one embodiment illustrated in FIG. 6, the interface port 53 has a forward section 70 and a rearward section 72 of the coupler engager 62. The forward section 70 is threaded, and the rearward section 72 is non-threaded. In another embodiment illustrated in FIG. 7, the interface port 55 has a coupler engager 74. In this embodiment, the coupler engager 74 is the same as coupler engager 58 except that it has a non-threaded, outer surface 76 and a threaded, inner surface 78. The threaded, inner surface 78 is configured to be inserted into, and threadably engaged with, a cable connector.

Referring to FIGS. 5-8, in one embodiment, the signal carrier 62 is tubular and configured to receive a pin or inner conductor engager 80 of the cable connector 68. Depending upon the embodiment, the signal carrier 62 can have a plurality of fingers 82 which are spaced apart from each other about the perimeter of the signal carrier 80. When the cable inner conductor 84 is inserted into the signal carrier 80, the fingers 82 apply a radial, inward force to the inner cable conductor 84 to establish a physical and electrical connection with the inner cable conductor 84. The electrical connection enables data signals to be exchanged between the devices that are in communication with the interface port. In one embodiment, the electrical ground 60 is tubular and configured to mate with a connector ground 86 of the cable connector 68. The connector ground 86 extends an electrical ground path to the ground 64 as described below.

Cables

In one embodiment illustrated in FIGS. 4 and 8-10, the networks 2 and 12 include one or more types of coaxial cables 88. In the embodiment illustrated in FIG. 8, the coaxial cable 88 has: (a) a conductive, central wire, tube, strand or inner cable conductor 84 that extends along a longitudinal axis 92 in a forward direction F toward the interface port 56; (b) a cylindrical or tubular dielectric, or insulator 96 that receives and surrounds the inner cable conductor 84; (c) a conductive tube or outer conductor 98 that receives and surrounds the insulator 96; and (d) a sheath, sleeve or jacket 100 that receives and surrounds the outer conductor 98. In the illustrated embodiment, the outer conductor 98 is corrugated, having a spiral, exterior surface 102. The exterior surface 102 defines a plurality of peaks and valleys to facilitate flexing or bending of the cable 88 relative to the longitudinal axis 92.

Figure 8:
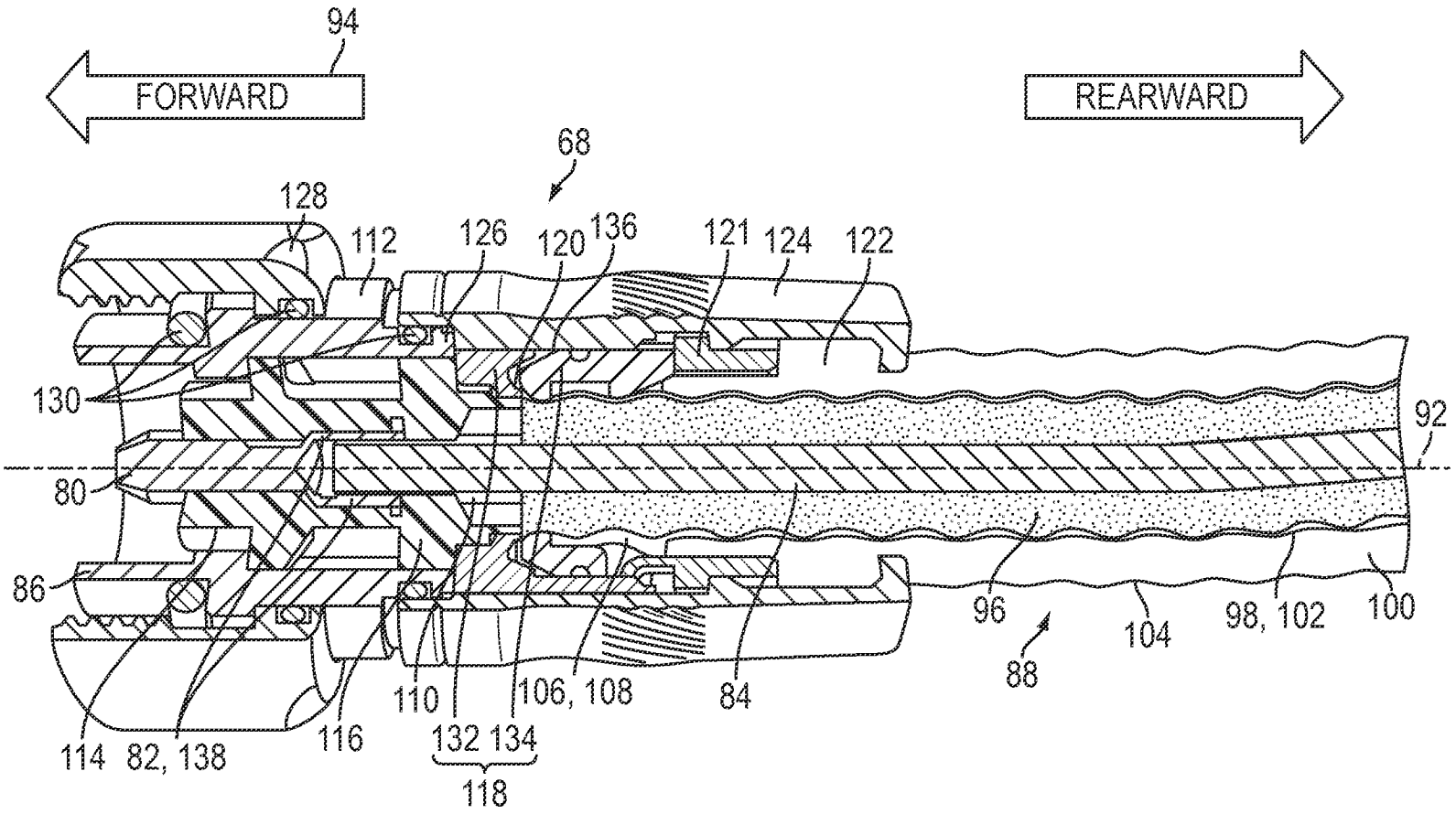
FIG. 8 is an isometric, cut-away view of one embodiment of a cable connector and cable.

To achieve the cable configuration shown in FIG. 8, an assembler/preparer, in one embodiment, takes one or more steps to prepare the cable 90 for attachment to the cable connector 68. In one example, the steps include: (a) removing a longitudinal section of the jacket 104 to expose the bare surface 106 of the outer conductor 108; (b) removing a longitudinal section of the outer conductor 108 and insulator 96 so that a protruding end 110 of the inner cable conductor 84 extends forward, beyond the recessed outer conductor 108 and the insulator 96, forming a step-shape at the end of the cable 68; (c) removing or coring-out a section of the recessed insulator 96 so that the forward-most end of the outer conductor 106 protrudes forward of the insulator 96.

In another embodiment not shown, the cables of the networks 2 and 12 include one or more types of fiber optic cables. Each fiber optic cable includes a group of elongated light signal guides or flexible tubes. Each tube is configured to distribute a light-based or optical data signal to the networks 2 and 12.

Connectors

In the embodiment illustrated in FIG. 8, the cable connector 68 includes: (a) a connector housing or connector body 112; (b) a connector insulator 114 received by, and housed within, the connector body 112; (c) the inner conductor engager 80 received by, and slidably positioned within, the connector insulator 114; (d) a driver 116 configured to axially drive the inner conductor engager 80 into the connector insulator 114 as described below; (e) an outer conductor clamp device or outer conductor clamp assembly 118 configured to clamp, sandwich, and lock onto the end section 120 of the outer conductor 106; (f) a clamp driver 121; (g) a tubular-shaped, deformable, environmental seal 122 that receives the jacket 104; (h) a compressor 124 that receives the seal 122, clamp driver 121, clamp assembly 118, and the rearward end 126 of the connector body 112; (i) a nut, fastener or coupler 128 that receives, and rotates relative to, the connector body 112; and (j) a plurality of O-rings or ring-shaped environmental seals 130. The environmental seals 122 and 130 are configured to deform under pressure so as to fill cavities to block the ingress of environmental elements, such as rain, snow, ice, salt, dust, debris and air pressure, into the connector 68.

In one embodiment, the clamp assembly 118 includes: (a) a supportive outer conductor engager 132 configured to be inserted into part of the outer conductor 106; and (b) a compressive outer conductor engager 134 configured to mate with the supportive outer conductor engager 132. During attachment of the connector 68 to the cable 88, the cable 88 is inserted into the central cavity of the connector 68. Next, a technician uses a hand-operated, or power, tool to hold the connector body 112 in place while axially pushing the compressor 124 in a forward direction F. For the purposes of establishing a frame of reference, the forward direction F is toward interface port 55 and the rearward direction R is away from the interface port 55.

The compressor 124 has an inner, tapered surface 136 defining a ramp and interlocks with the clamp driver 121. As the compressor 124 moves forward, the clamp driver 121 is urged forward which, in turn, pushes the compressive outer conductor engager 134 toward the supportive outer conductor engager 132. The engagers 132 and 134 sandwich the outer conductor end 120 positioned between the engagers 132 and 134. Also, as the compressor 124 moves forward, the tapered surface or ramp 136 applies an inward, radial force that compresses the engagers 132 and 134, establishing a lock onto the outer conductor end 120. Furthermore, the compressor 124 urges the driver 121 forward which, in turn, pushes the inner conductor engager 80 into the connector insulator 114.

The connector insulator 114 has an inner, tapered surface with a diameter less than the outer diameter of the mouth or grasp 138 of the inner conductor engager 80. When the driver 116 pushes the grasp 138 into the insulator 114, the diameter of the grasp 138 is decreased to apply a radial, inward force on the inner cable conductor 84 of the cable 88. As a consequence, a bite or lock is produced on the inner cable conductor 84.

Figure 5:
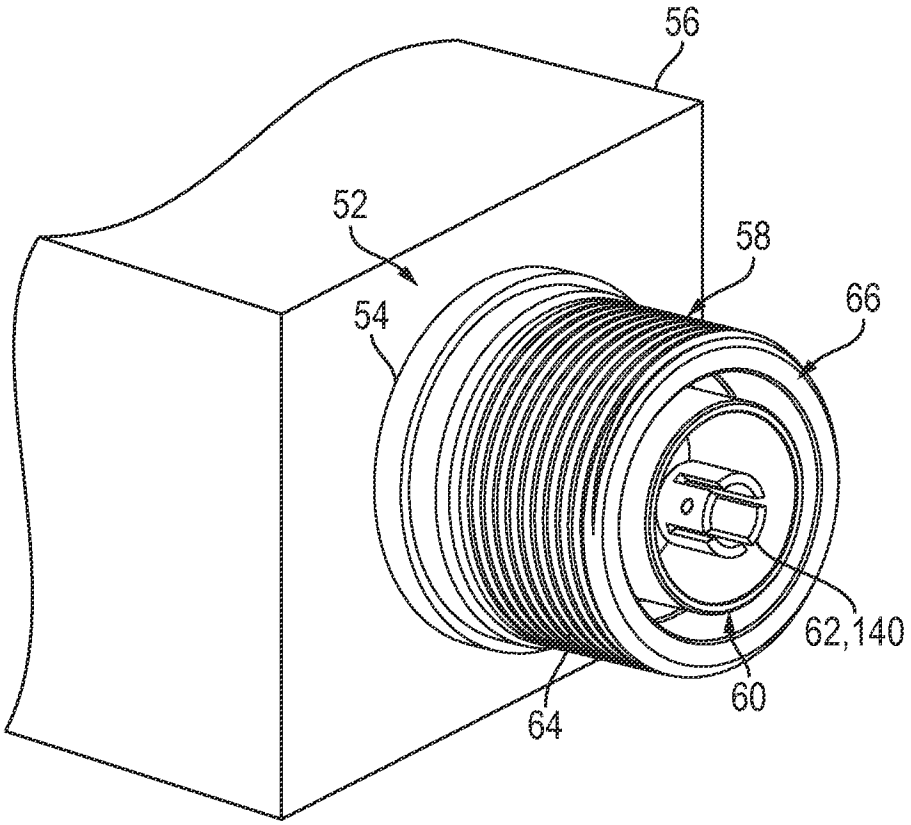
FIG. 5 is an isometric view of one embodiment of an interface port.

After the cable connector 68 is attached to the cable 88, a technician or user can install the connector 68 onto an interface port, such as the interface port 52 illustrated in FIG. 5. In one example, the user screws the coupler 128 onto the port 52 until the fingers 140 of the signal carrier 62 receive, and make physical contact with, the inner conductor engager 80 and until the ground 60 engages, and makes physical contact with, the outer conductor engager 86. During operation, the non-conductive, connector insulator 114 and the non-conductive driver 116 serve as electrical barriers between the inner conductor engager 80 and the one or more electrical ground paths surrounding the inner conductor engager 80. As a result, the likelihood of an electrical short is mitigated, reduced or eliminated. One electrical ground path extends: (i) from the outer conductor 106 to the clamp assembly 118, (ii) from the conductive clamp assembly 118 to the conductive connector body 112, and (iii) from the conductive connector body 112 to the conductive ground 60. An additional or alternative electrical grounding path extends: (i) from the outer conductor 106 to the clamp assembly 118, (ii) from the conductive clamp assembly 118 to the conductive connector body 112, (iii) from the conductive connector body 112 to the conductive coupler 128, and (iv) from the conductive coupler 128 to the conductive ground 60.

These one or more grounding paths provide an outlet for electrical current resulting from magnetic radiation in the vicinity of the cable connector 88. For example, electrical equipment operating near the connector 68 can have electrical current resulting in magnetic fields, and the magnetic fields could interfere with the data signals flowing through the inner cable conductor 84. The grounded outer conductor 106 shields the inner cable conductor 84 from such potentially interfering magnetic fields. Also, the electrical current flowing through the inner cable conductor 84 can produce a magnetic field that can interfere with the proper function of electrical equipment near the cable 88. The grounded outer conductor 106 also shields such equipment from such potentially interfering magnetic fields.

The internal components of the connector 68 are compressed and interlocked in fixed positions under relatively high force. These interlocked, fixed positions reduce the likelihood of loose internal parts that can cause undesirable levels of passive intermodulation ("PIM") which, in turn, can impair the performance of electronic devices operating on the networks 2 and 12. PIM can occur when signals at two or more frequencies mix with each other in a non-linear manner to produce spurious signals. The spurious signals can interfere with, or otherwise disrupt, the proper operation of the electronic devices operating on the networks 2 and 12. Also, PIM can cause interfering RF signals that can disrupt communication between the electronic devices operating on the networks 2 and 12.

In one embodiment where the cables of the networks 2 and 12 include fiber optic cables, such cables include fiber optic cable connectors. The fiber optic cable connectors operatively couple the optic tubes to each other. This enables the distribution of light-based signals between different cables and between different network devices.

Supplemental Grounding

Figure 4:
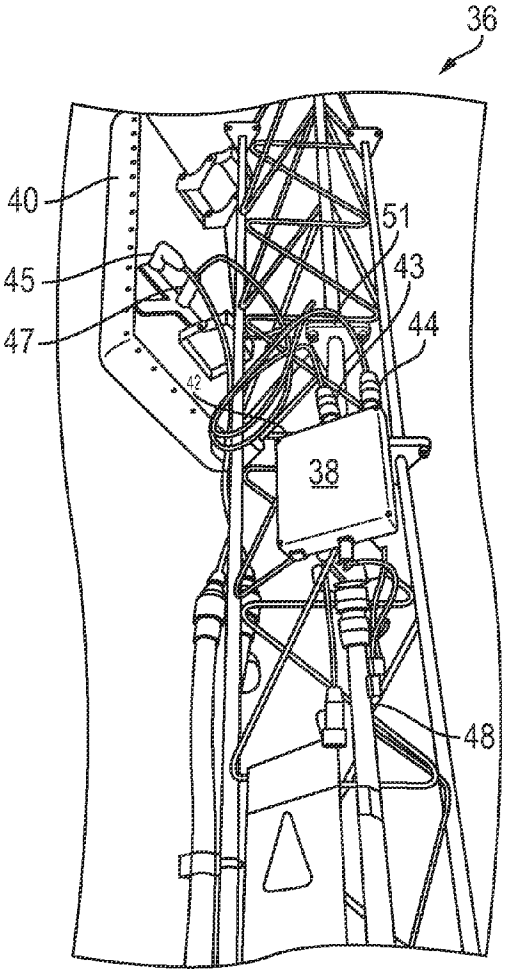
FIG. 4 is an isometric view of one embodiment of a tower.

In one embodiment, grounding devices are mounted to towers such as the tower 36 illustrated in FIG. 4. For example, a grounding kit or grounding device can include a grounding wire and a cable fastener which fastens the grounding wire to the outer conductor 106 of the cable 88. The grounding device can also include: (a) a ground fastener which fastens the ground wire to a grounded part of the tower 36; and (b) a mount which, for example, mounts the grounding device to the tower 23. In operation, the grounding device provides an additional ground path for supplemental grounding of the cables 88.

Environmental Protection

Figure 9:
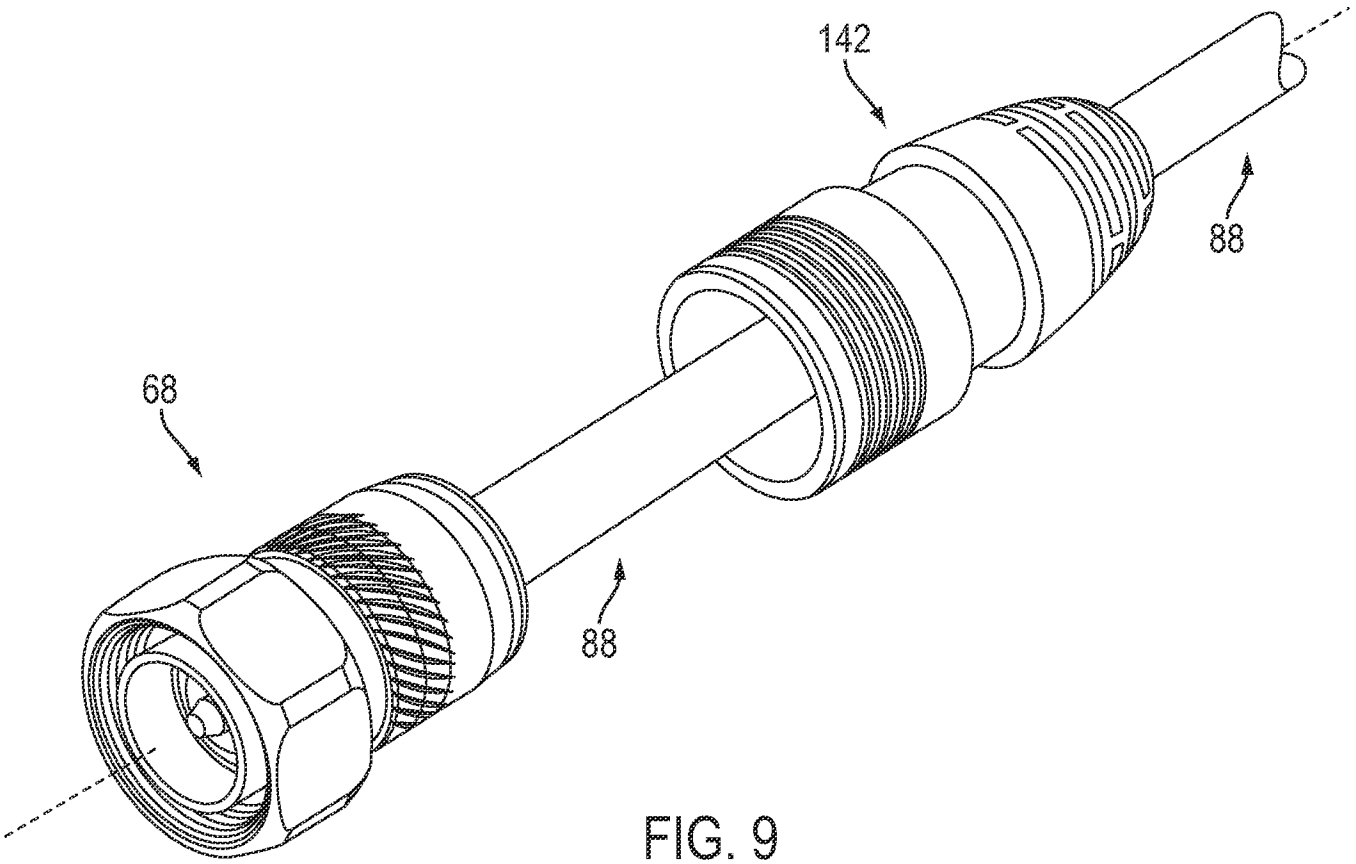
FIG. 9 is an isometric, exploded view of one embodiment of a cable assembly having a water resistant cover.
Figure 10:
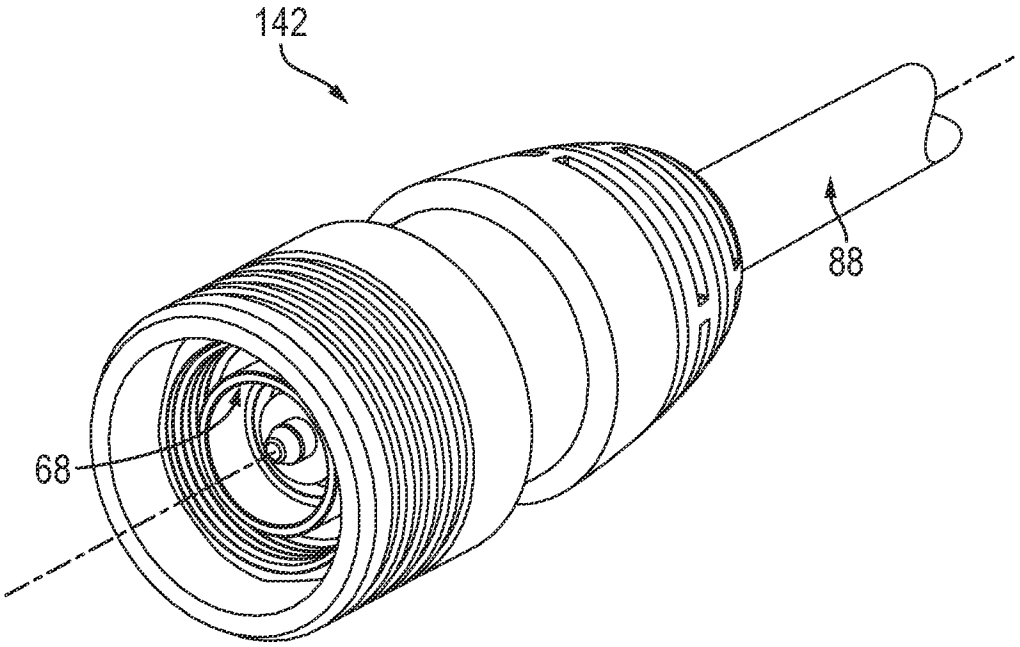
FIG. 10 is an isometric view of one embodiment of a cable connector covered by a water resistant cover.

In one embodiment, a protective boot or cover, such as the cover 142 illustrated in FIGS. 9-10, is configured to enclose part or all of the cable connector 88. In another embodiment, the cover 142 extends axially to cover the connector 68, the physical interface between the connector 68 and the interface port 52, and part or all of the interface port 52. The cover 142 provides an environmental seal to prevent the infiltration of environmental elements, such as rain, snow, ice, salt, dust, debris and air pressure, into the connector 68 and the interface port 52. Depending upon the embodiment, the cover 142 may have a suitable foldable, stretchable or flexible construction or characteristic. In one embodiment, the cover 142 may have a plurality of different inner diameters. Each diameter corresponds to a different diameter of the cable 88 or connector 68. As such, the inner surface of cover 142 conforms to, and physically engages, the outer surfaces of the cable 88 and the connector 68 to establish a tight environmental seal. The air-tight seal reduces cavities for the entry or accumulation of air, gas and environmental elements.

Materials

In one embodiment, the cable 88, connector 68 and interface ports 52, 53 and 55 have conductive components, such as the inner cable conductor 84, inner conductor engager 80, outer conductor 106, clamp assembly 118, connector body 112, coupler 128, ground 60 and the signal carrier 62. Such components are constructed of a conductive material suitable for electrical conductivity and, in the case of inner cable conductor 84 and inner conductor engager 80, data signal transmission. Depending upon the embodiment, such components can be constructed of a suitable metal or metal alloy including copper, but not limited to, copper-clad aluminum ("CCA"), copper-clad steel ("CCS") or silver-coated copper-clad steel ("SCCCS").

The flexible, compliant and deformable components, such as the jacket 104, environmental seals 122 and 130, and the cover 142 are, in one embodiment, constructed of a suitable, flexible material such as polyvinyl chloride (PVC), synthetic rubber, natural rubber or a silicon-based material. In one embodiment, the jacket 104 and cover 142 have a lead-free formulation including black-colored PVC and a sunlight resistant additive or sunlight resistant chemical structure. In one embodiment, the jacket 104 and cover 142 weatherize the cable 88 and connection interfaces by providing additional weather protective and durability enhancement characteristics. These characteristics enable the weatherized cable 88 to withstand degradation factors caused by outdoor exposure to weather.

2.0 Adjustable Power Divider/Coupler—Coil Tube Embodiment

The present disclosure describes a variable/adjustable power divider/combiner/coupler (hereinafter power divider, which may be employed to power a multiple antenna array. The power divider has a common internal geometry which may be used to split power at each branch of the antenna array in lieu of selecting from a multiplicity of individual/discrete power dividers. Each power divider comprises an input port operative to transmit input power along an inner or first conductor, a coupled port operative to receive a portion of the input power from the inner conductor, and a transmitted port operative to receive a remaining portion of the power transmitted along the inner conductor. The remaining portion of the power available may be conveyed by the transmitted port to other power dividers (downstream of the power divider).

The embodiment of the present disclosure enables the use of a common power divider to satisfy the coupling factors required for the exemplary antenna array described in the Background of the Invention. As mentioned above, the power divider is tunable, i.e., may be adjusted or reconfigured, to change the coupling factor or power ratio between the input and coupled ports of the power divider. In the described embodiment, the coupling factor or power ratio is the quotient of the power received/transmitted by the input port and the power diverted to the coupled port.

Figure 11:
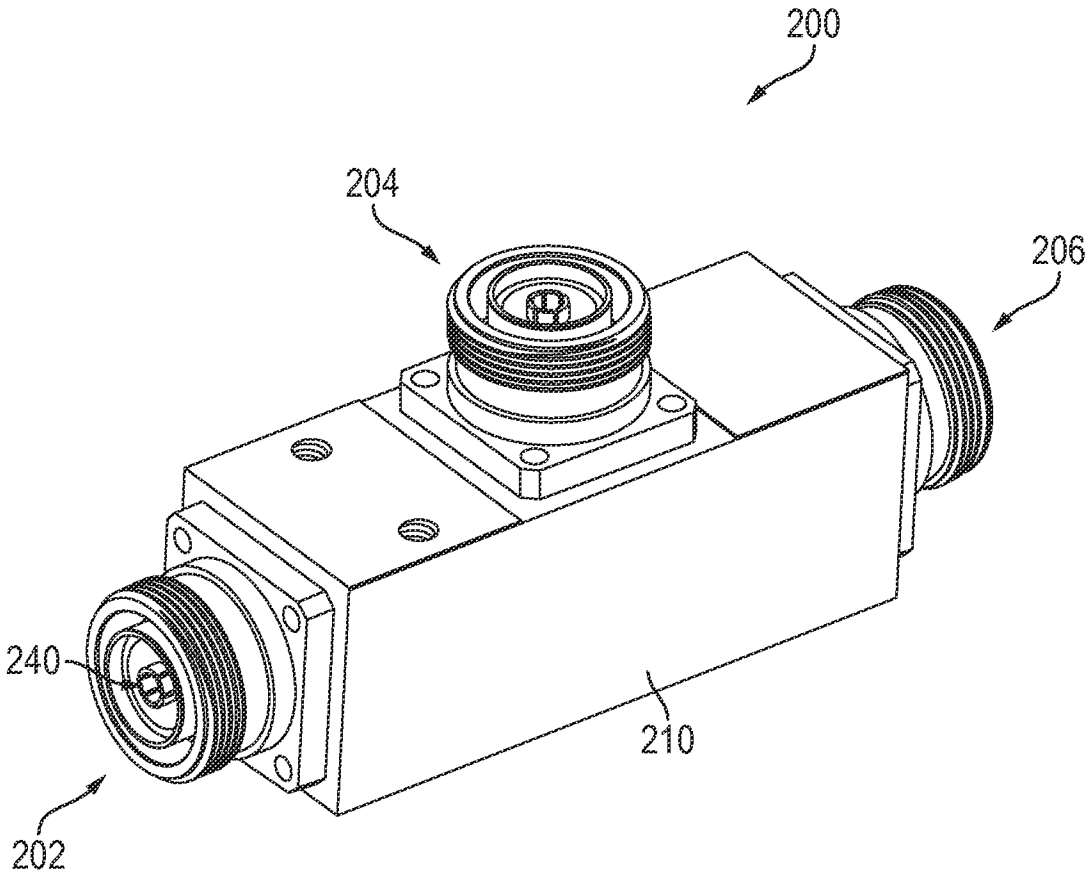
FIG. 11 is a perspective view of a first universal, tunable power divider/coupler having input, transmitted and coupled ports.
Figure 12:
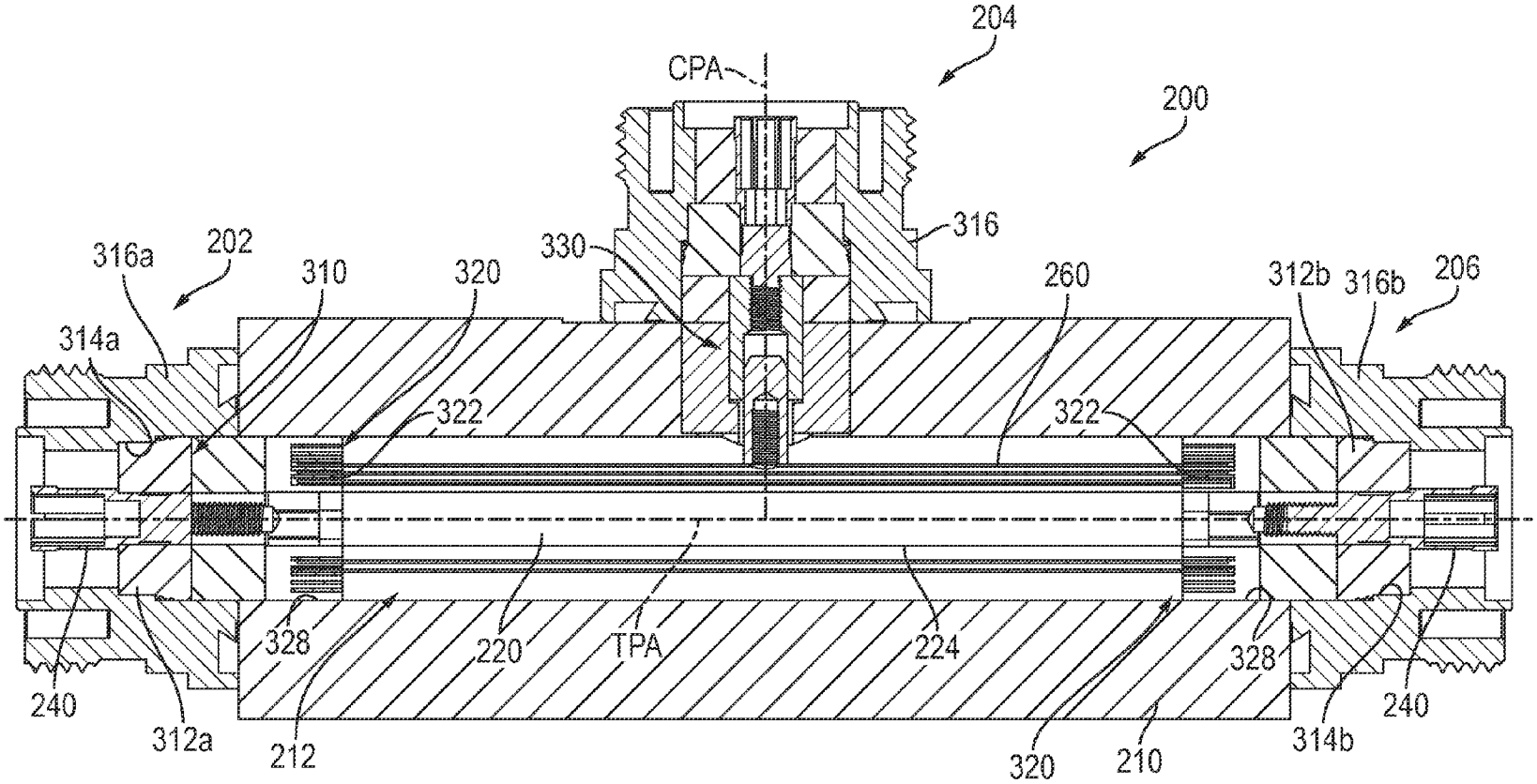
FIG. 12 is a cross-sectional view through a mid-plane of the power divider/coupler shown in FIG. 11.
Figure 13:
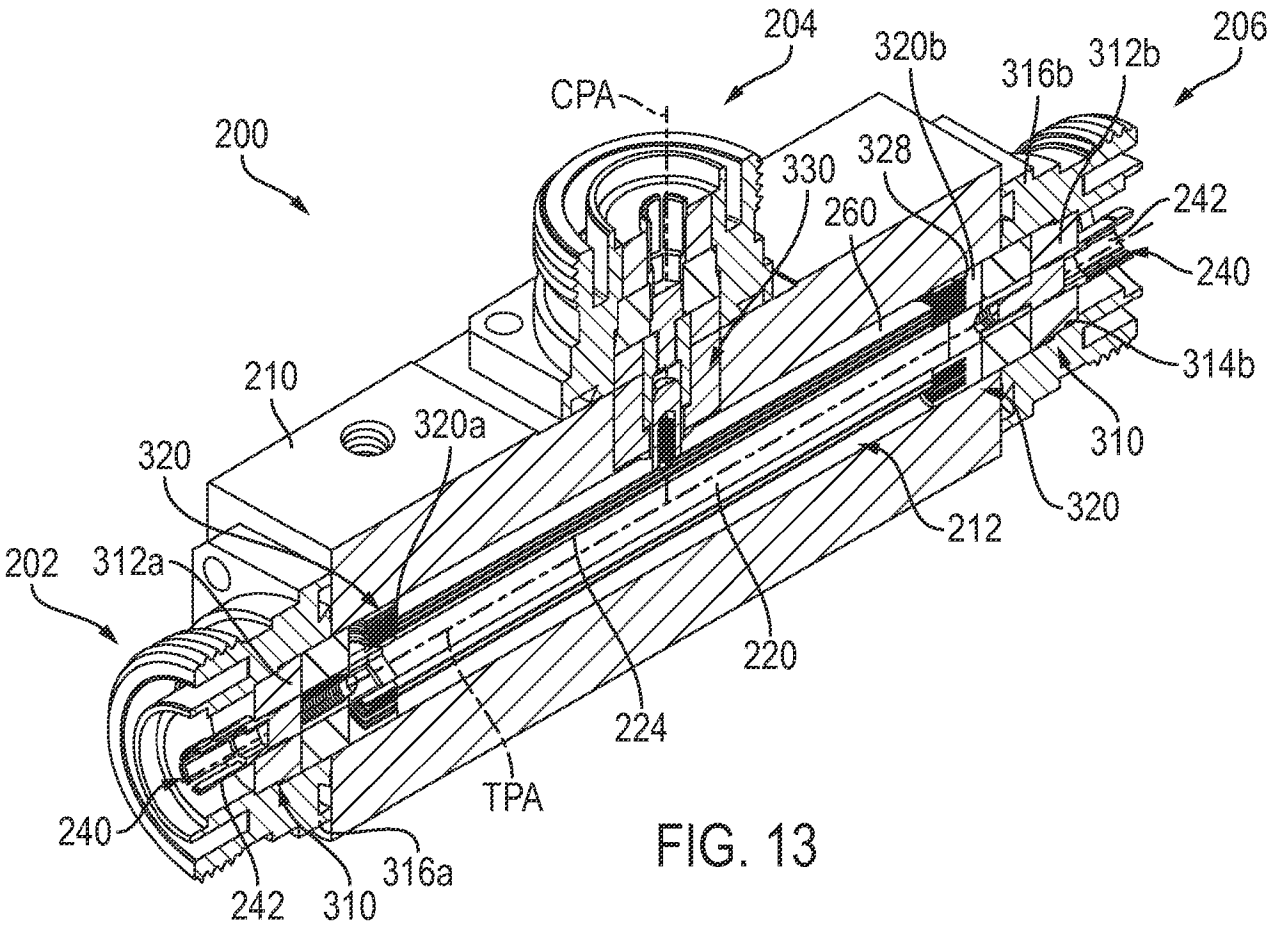
FIG. 13 is a perspective cross-sectional view of the power divider/coupler shown in FIG. 12.
Figure 14:
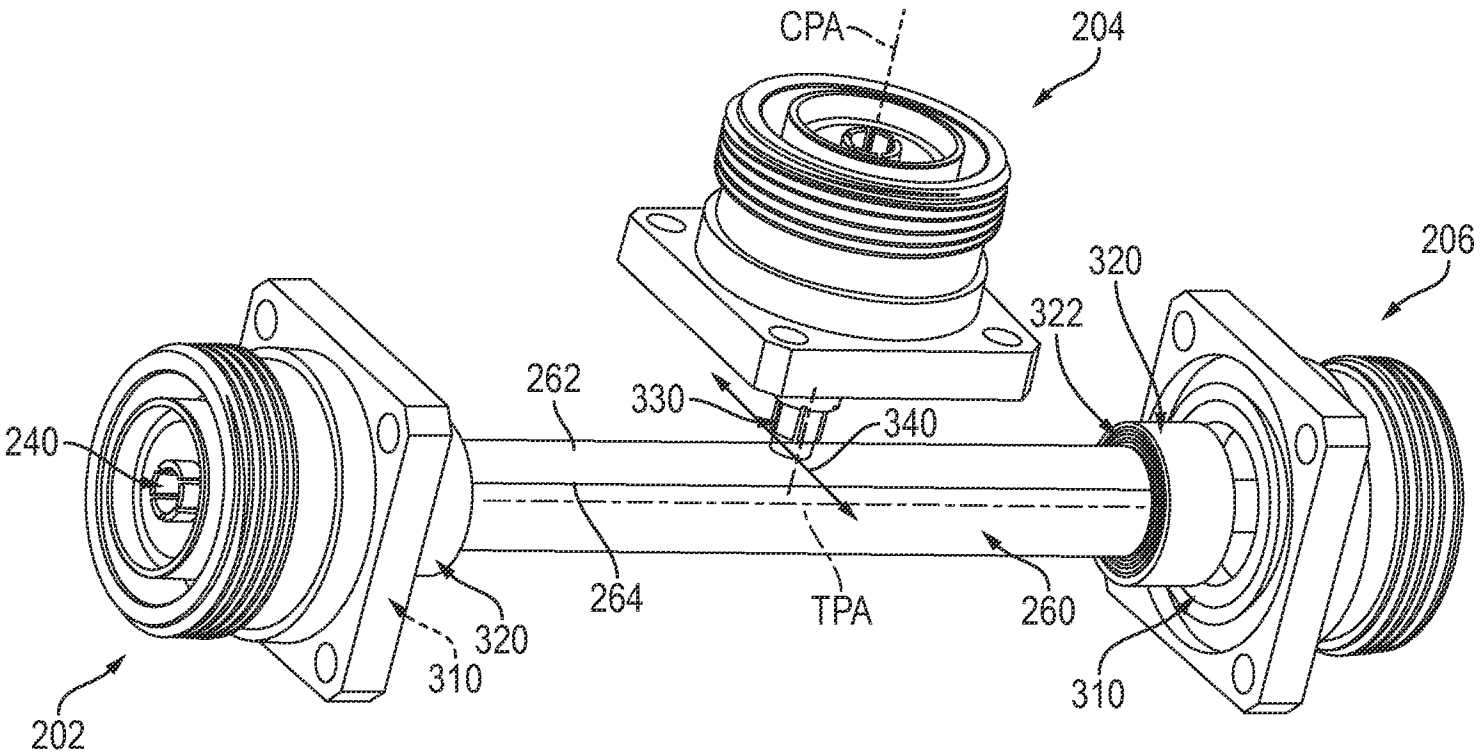
FIG. 14 is an isolated perspective view of the relevant components of the power divider/coupler including the input, transmitted and coupled ports, a coiled, variable diameter second conductor, a pair of end fittings operative to adjust the diameter of the second conductor, and a telescoping electrical mount extending from the coiled second conductor to the coupled port.

In FIGS. 11, 12 and 13 a power divider 200 according to one embodiment is depicted including an input port 202, a coupled port 204, and a transmitted port 206. The input port 202 is operative to receive/transmit electrical power from a power source (not shown). The coupled port 204 is operative to receive a diverted portion of the input power transmitted by the input port 202. The transmitted port 206 is, similarly, operative to receive a transmitted portion of the input power. The summation of the diverted and transmitted portions equal the total input power received/transmitted by the input port 202. In a first embodiment, the power divider 200 includes a conductive housing 210 to integrate the input, coupled and transmitted ports 202, 204, 206 while shielding the electrical signals transmitted by and between the ports 202, 204, 206. More specifically, the housing 210 defines an internal chamber 212 (see FIGS. 12 and 13) though which electrical power and signals are transmitted by and between the ports 202, 204, 206. The input and transmitted ports 202 and 206 are aligned along a common axis TPA1 while the coupled port 204 is aligned along an axis CPA which is substantially orthogonal to the axis TPA1. The import of such arrangement will become apparent in view of the subsequent detailed description.

The power divider 200 also includes a first or signal carrying inner conductor 220 (hereinafter "first conductor") electrically connecting and transmitting the electrical input power from the input to the transmitted ports 202, 206. The first conductor 220 also generates a variable strength electrical field which varies radially as a function of the distance from the geometric center of the first conductor 220. In the described embodiment, the field is strongest along the surface 224 of the first conductor 220 and diminishes exponentially as the radial distance increases from the surface 224.

Finally, the power divider 200 includes an second signal carrying, intermediate conductor 260 (hereinafter "second conductor") which at least partially envelops or circumscribes the first conductor 220. By "intermediate" is meant that the second conductor 260 is disposed between the first conductor 220 of the input port 202 and an inner conductor 330 of the coupled port 204. Furthermore, the second conductor 260 is disposed within, or intersects, the electrical field generated by the first conductor 220. Moreover, the second conductor 260 is electrically connected to the coupled port 204 and is configured to be variably spaced from the first conductor 220 to adjust the power ratio between the input and coupled ports 202, 204.

Figure 17:
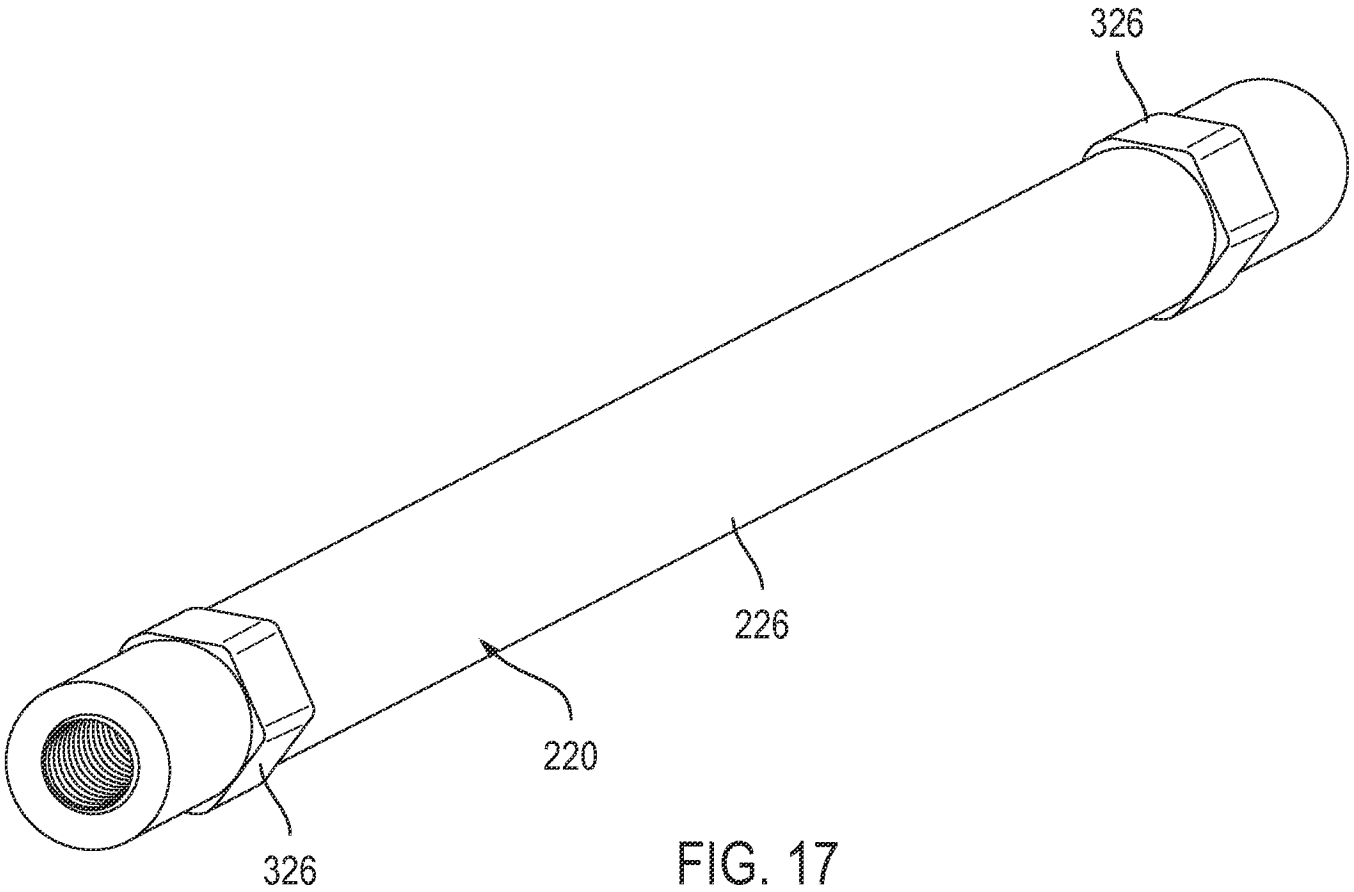
FIG. 17 is an isolated perspective view of the inner conductor having hex-shaped ends for engaging and driving the first and second end fittings.

In the described embodiment, the first conductor 220 comprises a conductive rod, tube or shaft 226 (see FIG. 17) extending from the input port 202 to the transmitted port 206 along axis TPA1. The ends of the first conductor 220 are journal mounted within, and electrically insulated from the outer bodies of the input and transmitted ports 202, 206. Furthermore, each end of the first conductor 220 terminates with, or forms a pin engager 240, having a plurality of resilient spring-fingers 242 (See FIG. 13) frictionally engaging the exposed outer surface of a conventional signal-carrying pin (not shown). As mentioned above, the current flowing through the first conductor 220 generates an electrical field which can be diverted along a secondary path, i.e., along line CPA, to the coupled port 204. The first conductor 220, therefore, transmits electrical power and signals, i.e., input power, from the input port 202 to the transmitted port 206.

In FIGS. 13-17, the second conductor 260 comprises a flexible conductive foil tube 262 disposed around the first conductor 220 to develop a current flow in the conductive foil tube 262. The foil tube 262 may be rolled to form a coiled tube which increases or decreases in diameter. At least one edge 264 of the foil tube 262 is substantially parallel to the axis TPA1 between the input and transmitted ports 202, 206, and is electrically connected to the coupled port 204 by a short telescoping mount (discussed in greater detail below). In the described embodiment, the flexible conductive foil 262 may increase in diameter by unraveling the tube 262, thereby increasing the spacing from the first conductor 220. Conversely, the flexible conductive foil 262 may decrease in diameter by raveling or coiling the tube 262, thereby decreasing the spacing between the conductive foil tube 262 and the first conductor 220. As the spacing increases, such as by unraveling the foil tube 262, the power diverted from the first conductor 220, i.e., to the coupled port 204, decreases. Similarly, as the spacing decreases, such as by raveling or coiling the conductive tube 262, the power diverted from the first conductor 220, and to the coupled port 204, increases.

In the described embodiment, the diameter of the conductive foil is expanded/increased or contracted/decreased by a scroll mechanism formed by: (i) a journal mount 310 facilitating rotation of the first conductor 220 about the axis TPA1, (ii) a radial adjustment 320 facilitating expansion and contraction of the second conductor 260 relative to the first conductor, and (iii) a telescoping mount 330 electrically connecting the foil tube 262 to the coupled port 204, and circumferentially restraining the foil tube 262 to prevent rotation about the axis TPA1.

The journal mount 310 comprises a pair of cylindrical bearings 312*a*, 312*b* supporting the first conductor 220 within an aligned pair of cylindrical bores 314*a*, 314*b* machined within each of the input and transmitted ports 202, 206. More specifically, each of the bores 314*a*, 314*b* is formed within the conductive outer bodies 316*a*, 316*b* of the input and transmitted ports 202, 206. Accordingly, the journal mount 310 facilitates rotation of the first conductor 220 about the elongate axis TPA1. Furthermore, each of the cylindrical bearings 312*a*, 312*b* electrically insulate the first conductor 220 from the conductive outer bodies 316*a*, 316*b* of the input and transmitted ports 202, 206.

Figure 16:
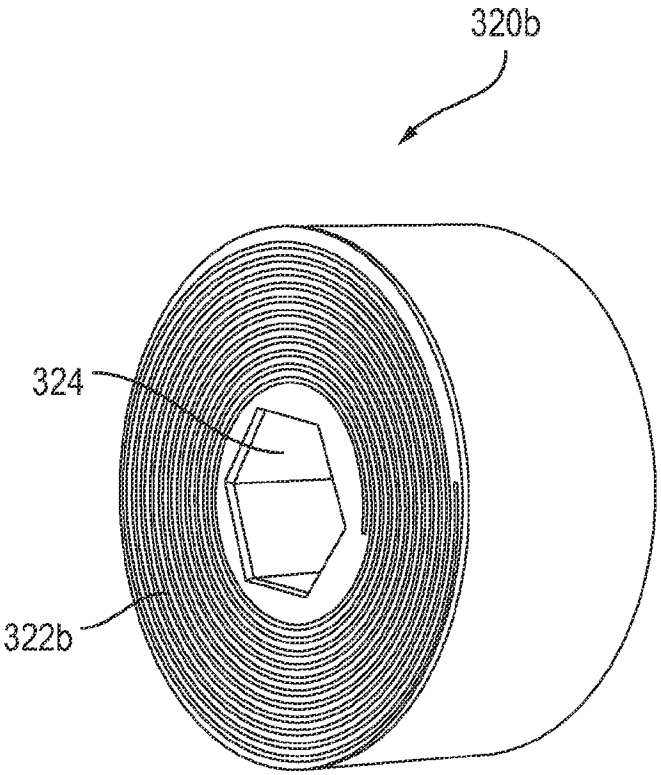
FIG. 16 is an isolated perspective view of a second end fitting having a spiral groove for guiding the expansion and contraction of the variable diameter second conductor.
Figure 15:
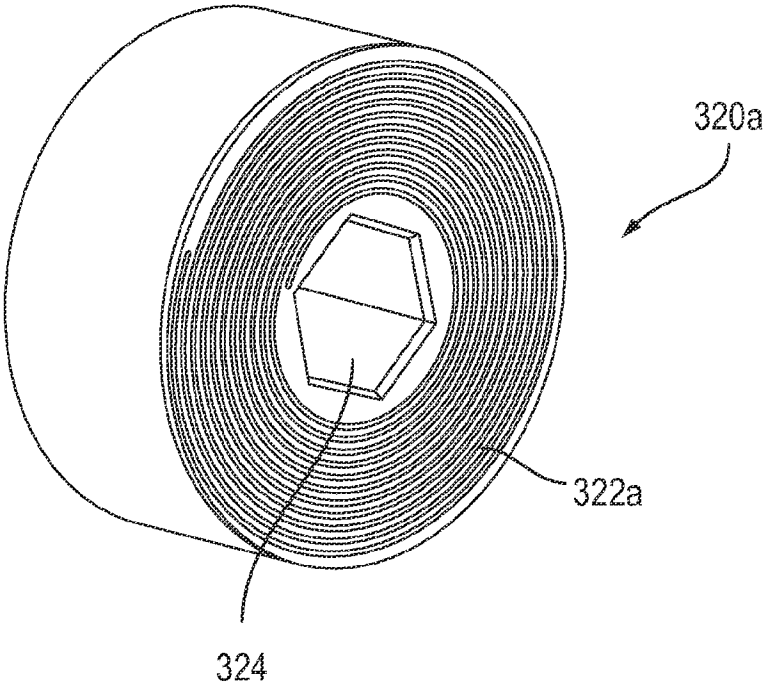
FIG. 15 is an isolated perspective view of a first end fitting having a spiral groove for guiding the expansion and contraction of the variable diameter second conductor.

The radial adjustment 320 includes at least one cylindrical, non-conductive, end fitting having a spiral groove 322 molded or machined into a face of the fitting 320. In the described embodiment, the radial adjustment 320 includes a first fitting 320*a* at one end of the coiled tube 262 and a second fitting 320*b* at the other end of the coiled tube 262. In FIGS. 13, 15 and 16, a first fitting 320*a* has a left-handed or counter-clockwise spiral groove 322*a* and the second fitting 320*b* has a right-handed or clockwise spiral groove 322*b*. Each of the fittings 320*a*, 320*b* have a hex-shaped opening 324 for receiving a hexagonally-shaped peripheral surface 326 of the first conductor 220. In the described embodiment, each of the radial adjustment fittings 320*a*, 320*b* are supported within a cylindrical bore 328 of the housing 210 and the hexagonally-shaped peripheral surface 326 of the first conductor 220 is formed inboard of the cylindrical bearings 312*a*, 312*b* of the journal mount 310. Finally, the spiral grooves 322*a*, 322*b* of the first and second adjustment fittings 320*a*, 320*b* receive the coiled ends of the conductive foil tube 262.

Figure 18:
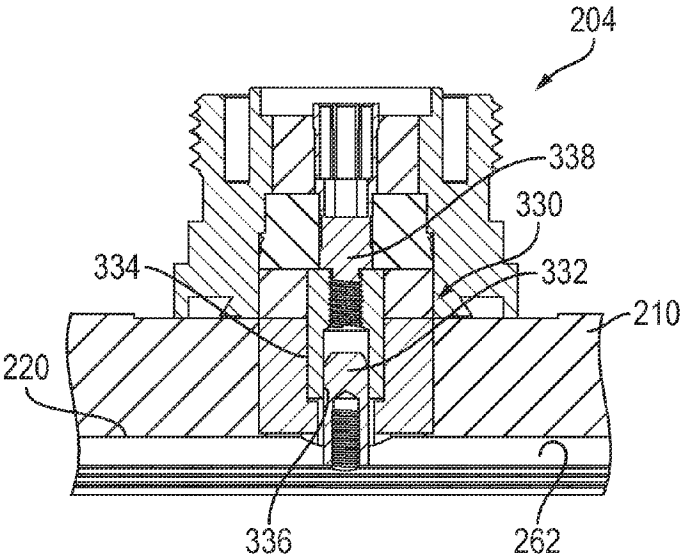
FIG. 18 is an enlarged, broken away, cross-sectional view of a telescoping mount electrically connecting the variable diameter second conductor to the coupled port.

In FIG. 18, the telescoping mount 330 includes a simple shaft/cylinder arrangement wherein a stub shaft 332 is mounted to, and projects radially from the conductive foil tube 262. A sleeve 334 receives the shaft 332 within a cylindrical bore 336 at one end thereof and threadably engages a pin receptacle 338 of the coupled port 204 at the other end. The telescoping mount 330 maintains electrical continuity between the coupled port 204 and the conductive foil tube 262.

In addition to providing electrical continuity between the coupled port 204 and second conductor 260, the mount 330 prevents rotation of an edge of the coiled tube 262 to allow the tube 262 to increase or decrease in diameter in response to rotation of the first conductor 220. More specifically, the telescoping mount 330 is sufficiently rigid in a transverse or tangential direction, i.e., in the direction of arrow 340 (See FIG. 14), to provide the requisite circumferential restraint. While the telescoping mount 330 provides the dual functions of: (i) electrically connecting the second conductor 260 to the coupled port 204 and (ii) preventing rotation of the conductive foil tube 262, it will be appreciated that a separate/independent structure may be used to perform each function.

Figure 19:
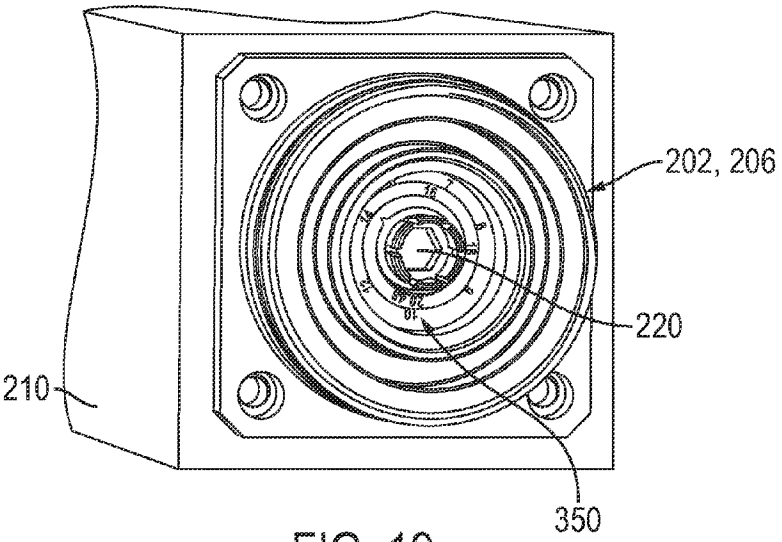
FIG. 19 depicts a broken-away end view of the power divider including indicia for setting the rotational position of the inner conductor to increase or decrease the diameter of the second conductor and the power ratio of the power divider.

In operation, rotation of the first conductor 220 on the journal mount 310 adjusts the diameter of the second conductor 260 which, in turn establishes an amount of power to be diverted from the first conductor 220 to the coupled port 204. More specifically, and referring to FIG. 19, an operator may use indicia 350 printed on the face of the input or transmitted ports 202, 206 to adjust the separation distance between the first and second conductors 220, 260, and consequently, the power ratio of the power divider 200. The indicia 350 may indicate the amount of power input, transmitted or diverted by the power divider 200. For example, the indicia 350 may indicate the power input, e.g., 20 dB, 10 dB, 10 Watts, 8 Watts, etc., via the input port 202 resulting in a predetermined/desired coupling factor. For example, if the desired power output at the coupled port is 2 Watts and the input power is 10 Watts, then operator will achieve a coupling factor of 5 (i.e., 10 Watts/2 Watts) with 8 Watts remaining to be transmitted at the transmitted port 206. In the described embodiment, a conventional Allen wrench may be used to rotate the shaft 226 of the first conductor 220.

To prevent inadvertent detuning of the power divider 200, a locking mechanism may be employed in combination with the input or transmitted ports 202, 206. More specifically, the scroll mechanism may be locked in place by a spring-loaded face gear or spline. That is, when pulled axially in an outward direction, the scroll mechanism may be movable/adjustable and, when released, the spring-loaded face gear or spline may lock in place to prevent inadvertent rotational movement of the scroll mechanism.

Furthermore, rotation of the first conductor shaft 226 on the journal mount 310 effects rotation of the radial adjustment fittings 320*a*, 320*b*. Inasmuch as the cylindrical foil tube 262 is rotationally fixed by the telescoping mount 330, rotation of the radial adjustment fittings 320*a*, 320*b* causes the tube 262 to increase or decrease in diameter. More specifically, rotation of the fittings 320*a*, 320*b* causes the spiral grooves 322*a*, 322*b* to rotate which, in turn, causes the ends of the cylindrical foil tube 262 to slide within the grooves 322*a*, 322*b*. As a result, the foil tube increases or decreases in diameter, i.e., as the ends slide within the grooves 322*a*, 322*b*. Counter-clockwise rotation of the first conductor 220 effects expansion of the conductive foil tube 262 relative to the first conductor 220 while clockwise rotation of the first conductor 220 effects contraction of the conductive foil tube 262 relative thereto. To accommodate the increase or decrease in diameter, the telescoping mount 330 allows the shaft 332 to slide within the bore of the sleeve 334 to maintain electrical contact between the second conductor 260 and the coupled port 204.

In the described embodiment, the diameter of the foil tube 262 may change by more than twenty millimeters (20 mm) from about eight millimeters (8 mm) to about thirty millimeters (30 mm). The power diverted from the input port 202 to the coupled port 204 decreases as the spacing between the first and second conductors 220, 260 increases. Similarly, and in contrast to the first geometric relationship, the power diverted increases as the spacing between the first and second conductors 220, 260 decreases. To maintain operational efficiency, the tube 262 of the second conductor 260 does not need to overlap or fully circumscribe the first conductor 220. In fact, the tube 262 will continue to function even when the tube inscribes an arc of about two-hundred and twenty degrees (220°) or about ⅔rds of a single revolution around the first conductor 220.

Figure 20:
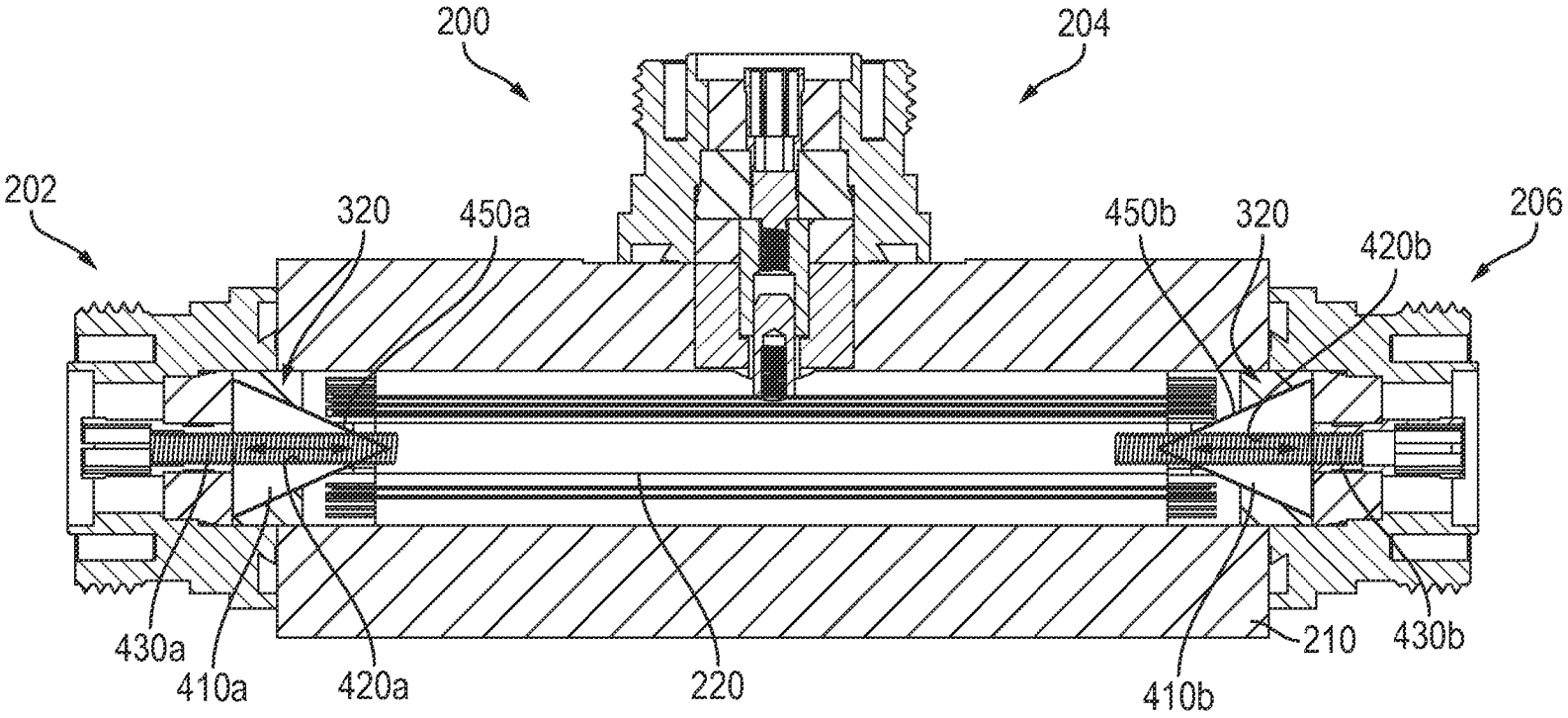
FIG. 20 depicts another embodiment of the disclosure wherein the end fittings include a pair of opposed conical members to vary the spacing between the inner and second conductors.

In another embodiment depicted in FIG. 20, the radial adjustment mechanism 320 may comprise a pair of opposed conical members 410*a*, 410*b* each having a threaded aperture 420*a*, 420*b* for threadably engaging an end of the first conductor 220. The ends 430*a*, 430*b* of the first conductor 220 comprise right and left hand threads such that rotation in one direction causes the conical members 410*a*, 410*b* to move axially apart, and rotation in the other direction causes the conical members 410*a*, 410*b* to move axially toward one another. The outer surface 450*a*, 450*b* of each conical member 410*a*, 410*b* engages an open end of the conductive tube 260, increasing the diameter of the tube 260 when the conical members 410*a*, 410*b* move axially together, and decreasing the diameter of the tube 260 when the conic members 410*a*, 410*b* move axially apart. With respect to the latter, closure or reduction in the tube diameter relies on the elastic/resilient properties of the tube 260. In this embodiment, as the spatial separation of the conical members 410*a*, 410*b* increases, the power diverted decreases, and as the spatial separation decreases, the power diverted increases.

Figure 21:
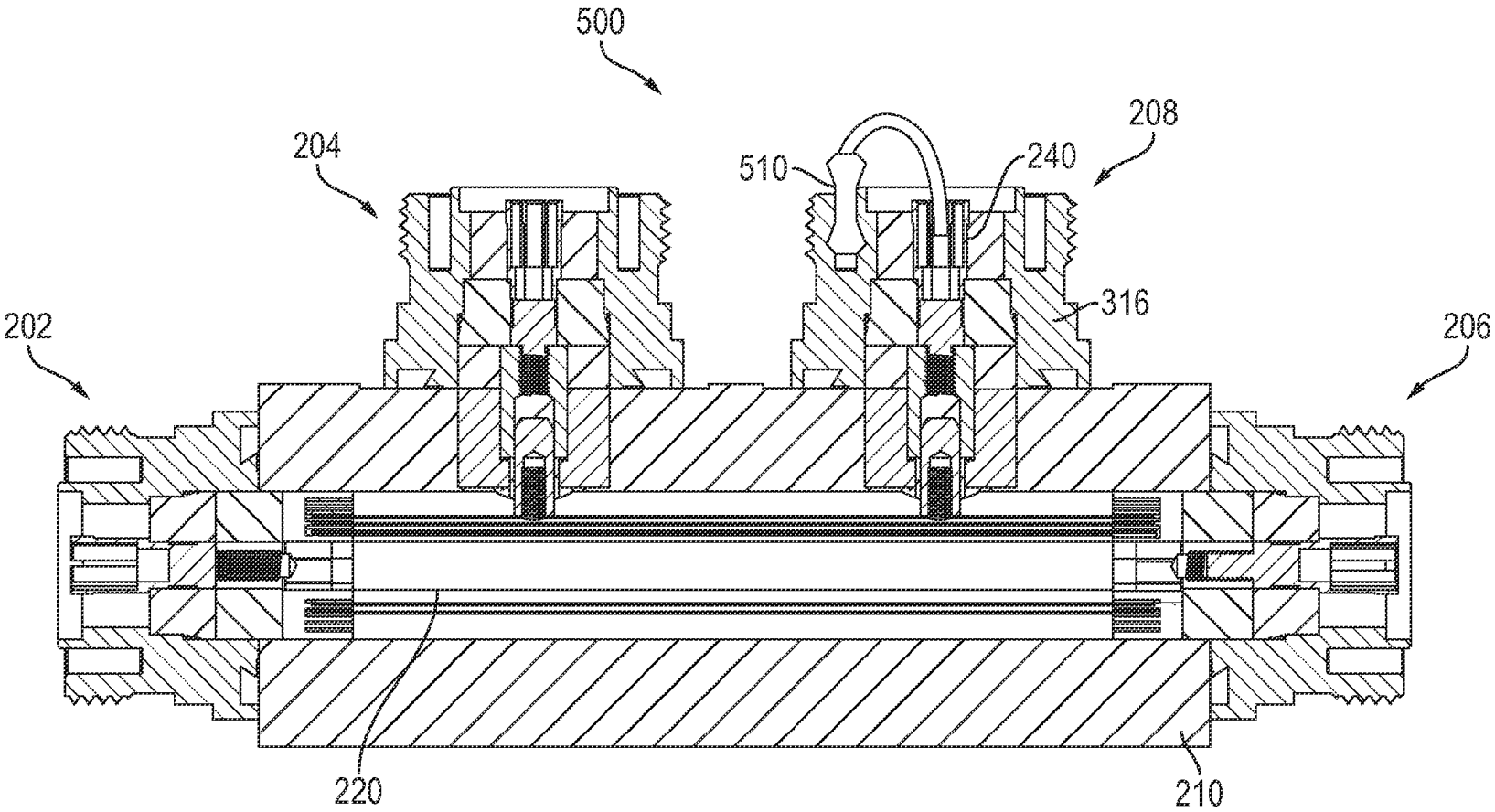
FIG. 21 depicts another embodiment of the disclosure wherein a power coupler is directional and employs an isolated port having a resistance terminal to improve the RF performance of the directional coupler.

In another embodiment shown in FIG. 21, a directional power divider 500 is disclosed. In this embodiment, a second coupled, or isolated port 208 is added to the input, coupled, and transmitted ports 202, 204, 206. More specifically, the isolated port 208 is disposed downstream of the first coupled port 204, and between the coupled 200 and the transmitted port 206. In this embodiment, the isolated port 208 is electrically connected to the second conductor 260 in essentially the same manner as the first coupled port 204, i.e., using a telescoping electrical mount 310S.

In this embodiment, a second coupled or isolated port 208 is terminated by a resistor 510, i.e., a resistor disposed between the inner and outer conductors 240, 316 of the isolated port 208. The resistor simulates the impedance of a coaxial cable and will include values which match the coaxial cables used in the system of antennae. Generally, the values of the resistor will be between approximately 50 ohms to approximately 75 ohms. Functionally, the isolated port 208 improves the RF performance of the power divider 500 by absorbing signal reflection. That is, by minimizing reflection back to the source, signal interference is mitigated.

3.0 Power/Directional Coupler (Eccentric/Cam Shape Conductor)

Figure 22:
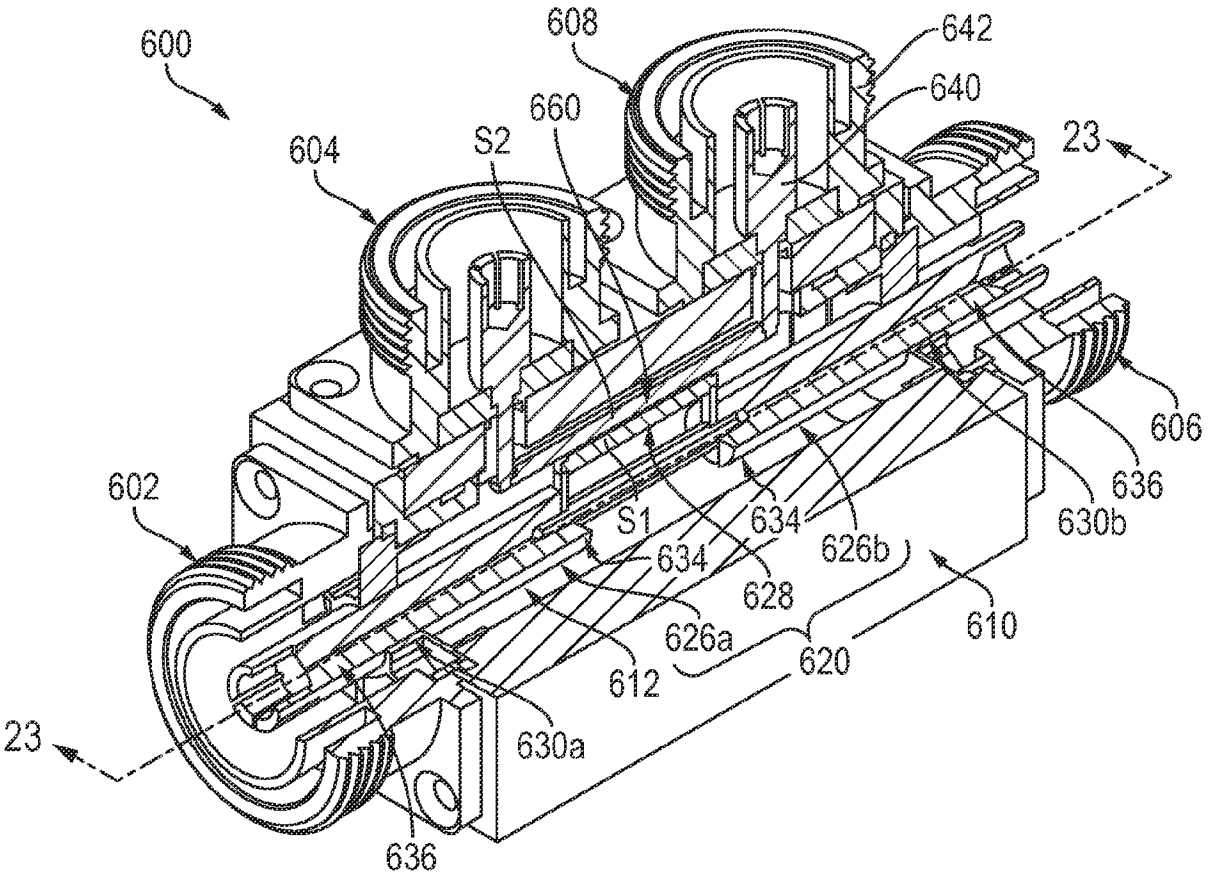
FIG. 22 is a cut-away, perspective view of a second embodiment of a tunable or adjustable power divider/coupler employing input, coupled, transmitted and isolator ports.
Figure 23:
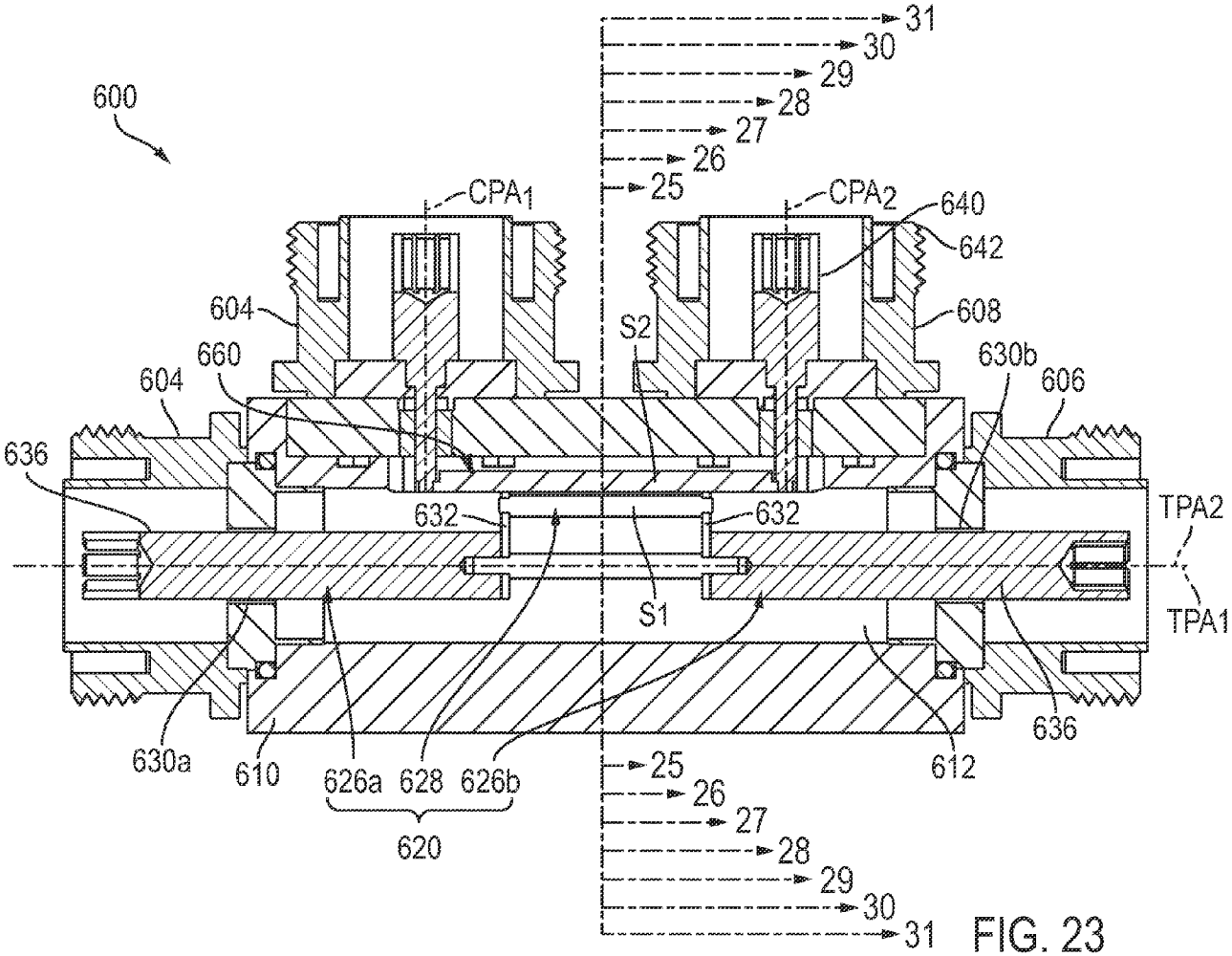
FIG. 23 is a cross-sectional view through a mid-plane of the power divider/coupler taken substantially along line 23-23 of FIG. 22.
Figure 24:
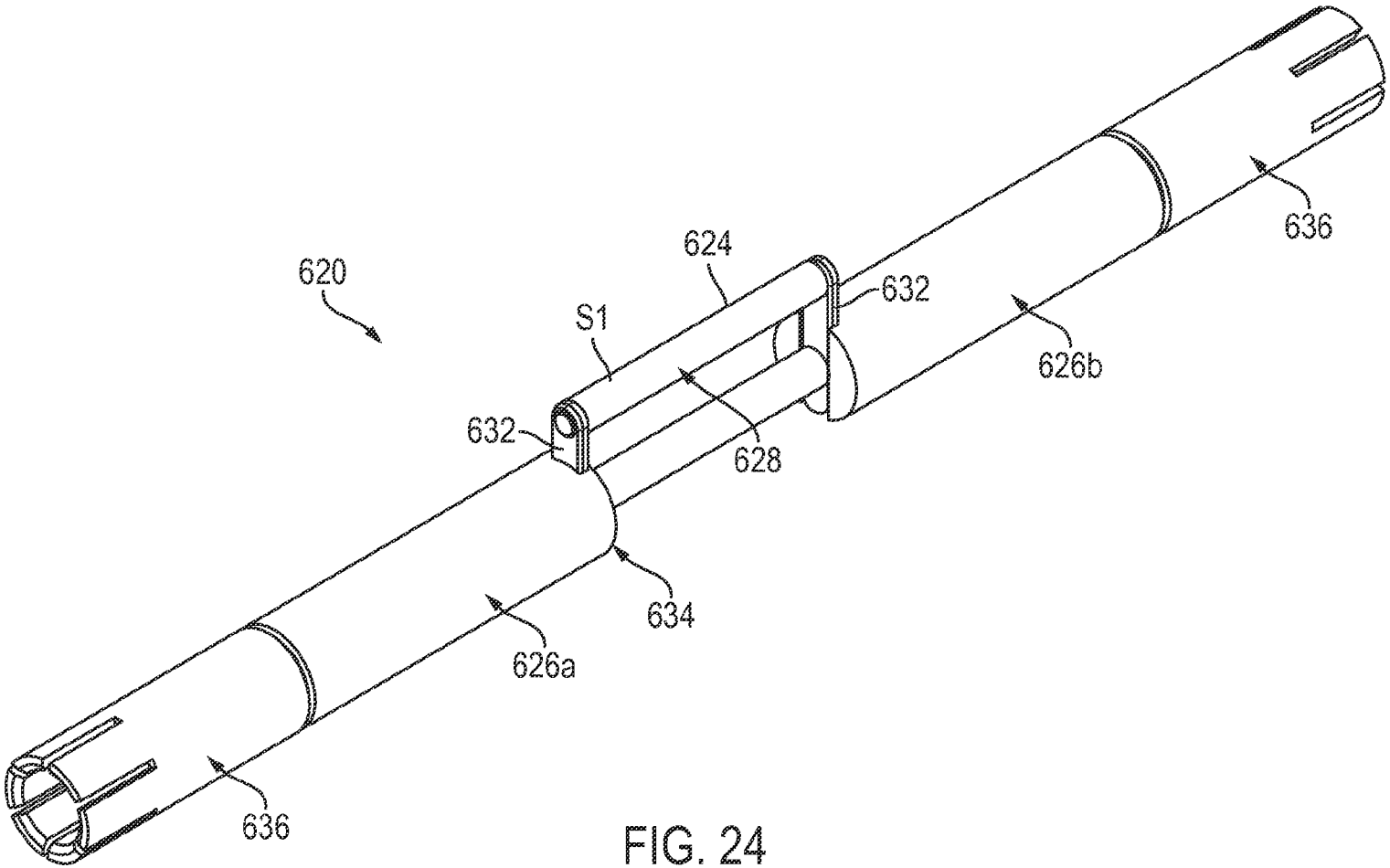
FIG. 24 is an isolated perspective view of the first or inner conductor operative to vary the power transmitted from the input to the coupled ports.

In FIGS. 22, 23 and 24 a power divider 600 according to another embodiment is depicted including an input port 602, a coupled port 604, and a transmitted port 606. In this embodiment, a second coupler or isolator port 608 is added to the other ports 602, 604, 606 to improve the RF performance of the power divider 600. That is, a resistor (not shown) is disposed between the inner and outer conductors 640 and 642 to simulate the impedance of a coaxial cable used in the antenna system. Furthermore, the resistor functions to minimize reflection back to the source, thereby mitigating signal interference.

The input port 602 is operative to receive/transmit electrical power from a power source (not shown). The coupled port 604 is operative to receive a diverted portion of the input power transmitted by the input port 602 while the transmitted port 606 is operative to receive a transmitted portion of the input power. The summation of the diverted and transmitted portions equal the total input power received/transmitted by the input port 602. In this embodiment, the power divider 600 includes a conductive housing 610 operative to integrate/combine the input, coupled, transmitted and isolator ports 602, 604, 606, 608. Furthermore, the conductive housing 610 shields the electrical signals transmitted by and between the ports 602, 604, 606, 608 while in operation. More specifically, the housing 610 defines an internal cylindrical chamber 612 (see FIGS. 22 and 23) though which electrical power and signals are transmitted by and between the ports 602, 604, 606, 608. The input and transmitted ports 602, 606 are aligned along a common axis TPA1, i.e., the elongate axis of the divider/coupler 600, while the coupled and isolator ports 604. 608 are aligned along parallel axes $CPA_1$ and $CPA_2$ which are substantially orthogonal to the common axis TPA1. The import of such arrangement will become apparent in view of the subsequent detailed description.

In the described embodiment, the power divider 600 includes a first power/signal carrying first or inner conductor 620 (hereinafter the first conductor) which transmits electrical power from the input port 602 to the transmitted port 606. That is, power is conveyed along the first conductor 620 to a second conductor 660 which is electrically connected to the transmitted port 606. Only, a portion of the total power is diverted from the input port 602, via the first conductor 620, to the coupled port 604, via the second conductor 660. In the described embodiment, the second conductor 660 is disposed within the electric field generated by the first conductor and is electrically coupled to the first conductor 620 by the spatial relationship between the first and second conductors 620, 660. Specifically, the first conductor 620 is exposed, i.e., not insulated or shielded, to produce an electrical field having a strength which varies exponentially as a function of the distance from the surface 624 of the conductor 620.

The power divider 600 of the present embodiment, may use of a variety of power coupling techniques including waveguide or transformer technologies. Inasmuch as the present coupler may use any of these technologies, time will not be devoted to the physics of how power is diverted, but only that power may be diverted using any one of a variety of known techniques.

In the described embodiment, the first conductor 620 includes an input portion 626*a*, an output portion 626*b*, and an eccentric portion 628. The input and output portions 626*a*, 626*b* each comprise a short axle or shaft which is concurrent and coaxial about a common axis TPA2. The eccentric portion 628 comprises a short rod or shaft S1 which is parallel to, and offset from, the input and output portions 626*a*, 626*b*. More specifically, the eccentric portion 628 is displaced from the axis TPA2 by a pair of supports or arms 632 (best seen in FIGS. 23 and 24) which project radially from an inboard end 634 of each of the input and output portions 626*a*, 626*b*. The input and output portions 626*a*, 626*b* are, furthermore, supported at the opposite or outboard ends 636 by journal bearing supports 630*a*, 630*b* disposed within each of the input and transmitted ports 602, 606. That is, the input portion 626*a* is supported within a first journal bearing 630*a* disposed at the center of the input port 602, while the output portion 626*b* is supported within a second journal bearing support 630*b* disposed at the center of the transmitted port 606. As such, the input and output portions 626*a*, 626*b* are configured to rotate about the common axis TPA2 such that the eccentric portion 628 rotates about the same axis TPA2. Accordingly, the eccentric portion 628 of the first conductor 620 may be angularly displaced within the cylindrical chamber 612 of the housing 610 resulting in spatial separation from the second conductor 660.

The second conductor 660 includes a short rod or shaft S2, similar in cross-sectional shape, length, and dimension, to the shaft S1 of the first conductor 620. The second conductor 660 is disposed between, and supported at each end by, the coupled and isolated ports 604, 608 such that the shaft of the second conductor 660 is substantially parallel, and adjacent to, the shaft of the eccentric portion 628 of the first conductor 620. Accordingly, the first conductor 620 includes a first shaft S1 which rotates about the rotational axis TPA2, while rotating toward and/or away from the second shaft S2 of the second conductor 660. It is this eccentric motion which variably spaces the first shaft S1 relative to the second shaft S2.

In FIGS. 25-31, the first conductor 620 may be rotated through various rotational positions to vary the spatial relationship, or spatial separation between, the first and second conductors 620, 660, i.e., the first and second shafts S1, S2. More specifically, the first conductor 620 may be rotated from a first angular position P1 (shown in FIG. 25), i.e., corresponding to zero degrees (0°) of rotation, to a second angular position P2 (shown in FIG. 31), i.e., corresponding to one hundred and eighty degrees (180°) of rotation. More specifically, at zero degrees (0°) of rotation shown in FIG. 25, the first conductor 620 is oriented such that the first, second, and eccentric portions 626*a*, 626*b*, 628, of the first conductor 620 are substantially co-planar with the second conductor 660. In this angular position, the shaft of the eccentric portion 628 lies between the first or second portions 626*a*, 626*b* of the first conductor 620 and the shaft of the second conductor 660. In this position, the conductors 620, 660 are at a minimum spatial separation, i.e., are proximal, to transfer a maximum of the available input power from the input port 602 to the coupled port 604.

Figure 31:
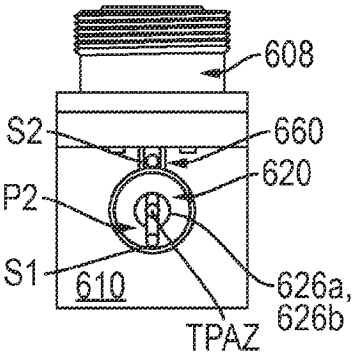
FIG. 31 is a cross-sectional view taken substantially along line 31-31 of FIG. 23.

When angularly positioned at one hundred and eighty degrees (180°), i.e., at position P2 depicted in FIG. 31, the first conductor 620 is oriented such that the first, second, and eccentric portions 626*a*, 626*b*, 628, of the first conductor 620 are substantially co-planar with the second conductor 660. However, in this angular position P2, the first or second portions 626*a*, 626*b* of the first conductor 620 lie between the shaft S1 of the eccentric portion 628 and the shaft S2 of the second conductor 660. Stated in the alternative, in this angular position, the shaft S2 is disposed on the opposite side of the rotational axis TPA2. Furthermore, in this position, the conductors 620, 660 are at a maximum spatial separation, i.e., are distal, to transfer a minimum of the available input power from the input port 602 to the coupled port 604.

Figure 25:
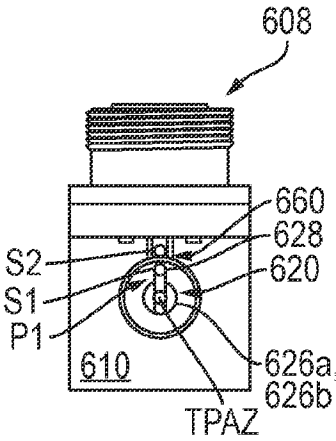
FIG. 25 is a cross-sectional view taken substantially along line 25-25 of FIG. 23.
Figure 26:
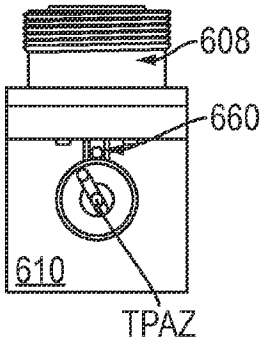
FIG. 26 is a cross-sectional view taken substantially along line 26-26 of FIG. 23.
Figure 27:
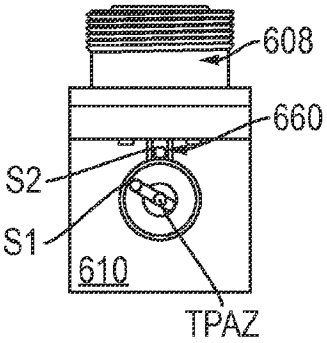
FIG. 27 is a cross-sectional view taken substantially along line 27-27 of FIG. 23.
Figure 28:
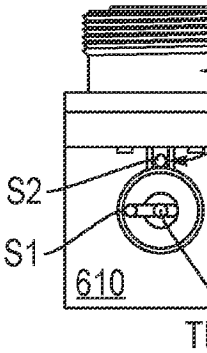
FIG. 28 is a cross-sectional view taken substantially along line 28-28 of FIG. 23.
Figure 29:
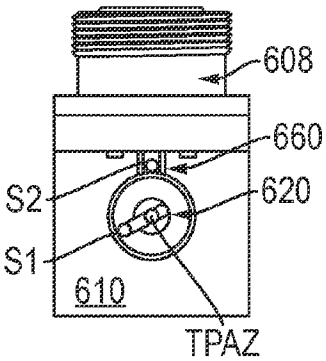
FIG. 29 is a cross-sectional view taken substantially along line 29-29 of FIG. 23.
Figure 30:
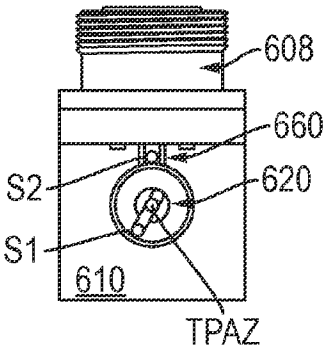
FIG. 30 is a cross-sectional view taken substantially along line 30-30 of FIG. 23.

FIGS. 25 and 31 depict the first and second conductors 620, 660 at their minimum and maximum spatial separation distance to show the range of motion to divert power from the first to the second conductors 620, 660. FIGS. 26 though 30 depict other possible positions including thirty degrees (30°) of rotation (FIG. 26), sixty-degrees (60°) of rotation (FIG. 27), ninety-degrees (90°) of rotation (FIG. 28), one-hundred twenty-degrees (120°) of rotation (FIG. 29), and one-hundred and fifty-degrees (150°) of rotation (FIG. 30).

In operation, rotation of the first conductor 620 on the journal bearings 630*a*, 630*b* causes the eccentric portion 628 of the first conductor 620 to be angularly positioned relative to the second conductor 660. The selected angular position effects a spatial separation corresponding to a desired level of power diversion. An operator may use indicia 350, such as that shown in FIG. 19, printed on the face of the input or transmitted ports 602, 606 to adjust the separation distance between the first and second conductors 620, 660, and consequently, the power ratio of the power divider 600. The indicia 350 may indicate the amount of power input, transmitted or diverted by the power divider 600. For example, the indicia 350 may indicate the power input, e.g., 20 dB, 10 dB, 10 Watts, 8 Watts, etc., via the input port 602 resulting in a predetermined/desired coupling factor. For example, if the desired power output at the coupled port is 2 Watts and the input power is 10 Watts, then operator will achieve a coupling factor of 5 (i.e., 10 Watts/2 Watts) with 8 Watts remaining to be transmitted at the transmitted port 606.

Figure 33:
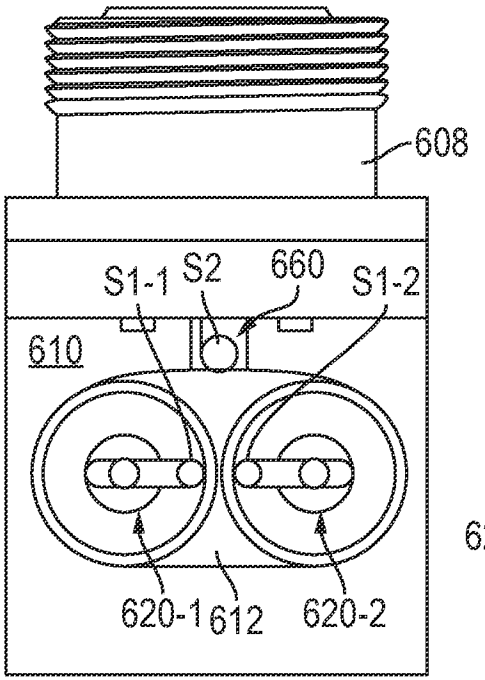
FIG. 33 depicts an another alternate embodiment of the description wherein the first conductor is bi-furcated to form a pair of eccentric conductors which are coordinated to share in diverting power from the input port to the coupler port.
Figure 32:
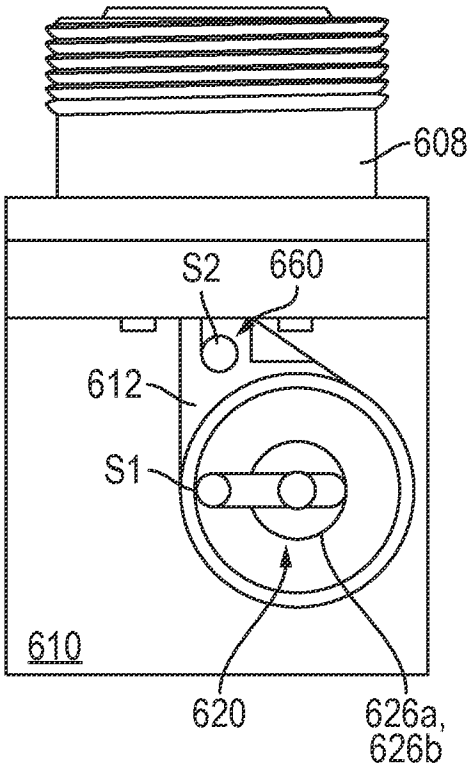
FIG. 32 depicts an alternate embodiment of the description wherein the rotational axis of the first conductor is off-set from the longitudinal axis of the divider/coupler.

In the described embodiment, the first shaft S1 of the first conductor 620 is parallel to the shaft S2 of the second conductor 660. They are approximately equal in length, cross-sectional area and cross-sectional shape, i.e., circular or annular. The first and second conductors 620, 660 are substantially parallel, however, they may be non-parallel, off-set, or off-axis such that an angle is produced therebetween. While the axis TPA1 across the input and transmitted ports 602, 606 and the rotational axis TPA2 of the first conductor 620 may be coincident, it will be appreciated that other mounting arrangements are possible. For example FIGS. 32 and 33 depict alternate arrangements for mounting the first conductor 620 within the chamber 612 of the housing 610. In FIG. 32, the first conductor is offset such that a relatively small angular displacement of the input and output portions 626*a*, 626*b* produces a large spatial displacement between the first and second shafts S1, S2. In FIG. 33, the first conductor 620 is bifurcated such that two current carrying conductors 620-1, 620-2 having eccentric shafts S1-1, S1-2, respectively, are disposed to each side of the second shaft S2 of the second conductor 620. As such, coordinated displacement/rotation of the eccentric shafts S1-1, S1-2, produces a shared amount of diverted input energy/power to the coupled port 604.

Figure 34:
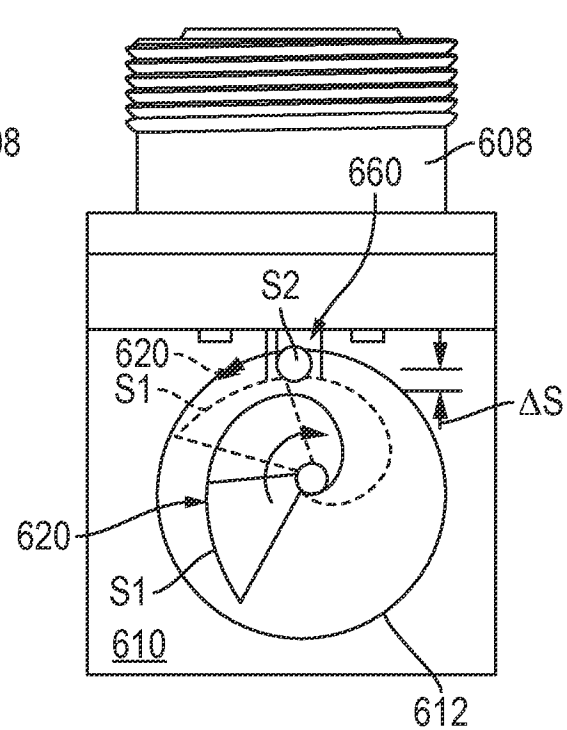
FIG. 34 depicts an another alternate embodiment of the description wherein the eccentric portion includes a cam or spiral shape such that rotation of the first conductor varies the spatial separation between the first and second conductors.

While, in the described embodiment, the first conductor 620 includes an eccentric shaft S1, it will be appreciate that other shapes and contours are contemplated. For instance, FIG. 34 depicts an first conductor 620 having a cam shaped or spiral profile. As such, rotation of the input and output portions 626*a*, 626*b* about the rotational axis TPA2 varies the spatial separation between the first and second conductors 620, 660. In FIG. 34, the spatial separation ΔS varies, e.g., is reduced, as the first conductor 620 rotates from a first rotational position, shown in solid lines, to a second rotation position shown in dashed or phantom lines. Furthermore, the eccentric portion may comprise a conductive cam surface having an asymmetric outer surface contour.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Coaxial Cable Connector Having An RF Shielding Member Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. An adjustable power divider comprising:

an input port configured to receive an electrical power input;

a coupled port configured to transmit a diverted portion of the power input;

the power input and diverted portion of the power input defining a coupling factor;

a transmitted port configured to transmit a transmitted portion of the power input;

a first conductor electrically connecting the input port to the transmitted port, and generating a variable strength electrical field;

a radial adjustment mechanism disposed at each end of the first conductor and between the input and transmitted ports, and a second conductor electrically connected to the coupled port and configured to be variably spaced from the first conductor to adjust the coupling factor wherein the second conductor includes a conductive foil tube at least partially circumscribing the first conductor, wherein the radial adjustment mechanism comprises first and second fittings disposed at each end of the first conductor, each fitting having a spiral groove for accepting an end of the second conductor, and wherein rotation of the first conductor effects rotation of the foil tube in the spiral grooves to increase and decrease the diameter of the second conductor relative to the first conductor.

2. The adjustable power divider of claim 1, wherein the second conductor is configured to be variably spaced from the first conductor by a scroll mechanism, the scroll mechanism comprising:

a journal mount for rotationally mounting the first conductor between the input and transmitted ports, a radial adjustment mechanism increasing and decreasing the separation distance of the second conductor relative to the first conductor in response to rotation of the first conductor; and a telescoping mount electrically connecting the second conductor to the coupled port.

3. The adjustable power divider of claim 1 wherein the conductive foil tube inscribes an arc greater than about two-hundred and twenty degrees.

4. The adjustable power divider of claim 1 further comprising a locking mechanism configured to prevent the inadvertent detuning of the coupled port.

5. The adjustable power divider of claim 2 further comprising a locking mechanism operative to prevent inadvertent rotation of the scroll mechanism and variation of the coupling factor.

6. A power divider comprising:

an input port receiving an electrical power input;

a coupled port transmitting a portion of the power input, the electrical power input and transmitted portions defining a coupling factor;

a transmitted port transferring a remaining portion of the power input from the input port;

a first conductor producing an electrical field and electrically connecting the input port to the transmitted port, a radial adjustment mechanism disposed at each end of the first conductor and between the input and transmitted ports, and a second conductor disposed within the electrical field of the first conductor and electrically connected to the coupled port, wherein the first and second conductors are configured to be variably spaced to vary the coupling factor, and wherein the second conductor includes a conductive foil tube disposed, at least partially around, the first conductor, the second conductor responsive to the radial adjustment mechanism such that rotation thereof causes the conductive foil tube to be spaced-apart from the first conductor by opening and closing the coil tube around the first conductor.

7. The power divider of claim 6 wherein the first conductor includes an eccentric portion rotatable from a first angular position to a second angular position which causes the eccentric portion of the first conductor to be variably spaced from the second conductor.

8. The power divider of claim 7 wherein the first angular position corresponds to a zero degree position and the second angular position corresponds to a ninety-degree angular position.

9. The power divider of claim 8 wherein the first angular position corresponds to a zero degree position and the second angular position corresponds to a one-hundred and eighty-degree angular.

10. The adjustable power divider of claim 6 wherein the second conductor includes a conductive foil tube at least partially circumscribing the first conductor, wherein the radial adjustment mechanism comprises first and second fittings disposed at each end of the first conductor, each fitting having a spiral groove for accepting an end of the second conductor, and wherein rotation of the first conductor effects rotation of the foil tube in the spiral grooves to increase and decrease the diameter of the second conductor relative to the first conductor.

11. The adjustable power divider of claim 6, wherein the second conductor is configured to be variably spaced from the first conductor by a scroll mechanism, the scroll mechanism comprising:

a journal mount for rotationally mounting the first conductor between the input and transmitted ports, a radial adjustment mechanism increasing and decreasing the separation distance of the second conductor relative to the first conductor in response to rotation of the first conductor; and a telescoping mount electrically connecting the second conductor to the coupled port.

12. A directional coupler, comprising:

an input port receiving an electrical power input;

a coupled port transmitting a portion of the power input; the electrical power input and transmitted portions defining a coupling factor;

an isolated port adjacent to the coupled port and receiving a diverted portion of the power input;

a transmitted port transferring a remaining portion of the power input from the input port;

a first conductor producing an electrical field and electrically connecting the input port to the transmitted port, a radial adjustment mechanism disposed at each end of the first conductor and between the input and transmitted ports, and a second conductor disposed within electrical field of the first conductor and electrically connected to the coupled port, wherein the first and second conductors are configured to be variably spaced to vary the coupling factor, wherein the second conductor includes a conductive foil tube at least partially circumscribing the first conductor, wherein the radial adjustment mechanism comprises first and second fittings disposed at each end of the first conductor, each fitting having a spiral groove for accepting an end of the second conductor, and wherein rotation of the first conductor effects rotation of the foil tube in the spiral grooves to increase and decrease the diameter of the second conductor relative to the first conductor.

13. The directional coupler of claim 12 wherein the isolated port has inner and outer conductors and a resistor electrically connected to, and interposing, the inner and outer conductors, the resistor simulating the impedance of a coaxial cable.

* * * * *